US006837173B2

(12) United States Patent
Eck et al.

(10) Patent No.: US 6,837,173 B2
(45) Date of Patent: Jan. 4, 2005

(54) WATERCRAFT

(75) Inventors: Richard E. Eck, Mount Vernon, IL (US); Denis Pageau, West Frankfort, IL (US); David Kalhok, Marion, IL (US); Eric Plumb, Delle Rive, IL (US); William Romeo, Carterville, IL (US); Gary Braden, Benton, IL (US)

(73) Assignee: Bombardier Recreational Products Inc., Saint-Bruno (CA)

( * ) Notice: Subject to any disclaimer, the term of this patent is extended or adjusted under 35 U.S.C. 154(b) by 3 days.

(21) Appl. No.: 10/209,658

(22) Filed: Aug. 1, 2002

(65) Prior Publication Data

US 2003/0183150 A1 Oct. 2, 2003

Related U.S. Application Data

(60) Provisional application No. 60/308,853, filed on Aug. 1, 2001.

(51) Int. Cl.[7] ..... B63B 35/73

(52) U.S. Cl. ..... 114/55.53; 114/361; 114/363; 440/89 J

(58) Field of Search ..... 114/55.53, 343, 114/364, 361, 363, 274, 291; 440/89 R, 89 J

(56) References Cited

U.S. PATENT DOCUMENTS

| | | | | |
|---|---|---|---|---|
| 2,713,841 | A | | 7/1955 | Forbes |
| 2,766,714 | A | | 10/1956 | Hammers |
| 3,290,706 | A | | 12/1966 | Hale |
| 3,379,471 | A | | 4/1968 | Dalziel |
| 3,428,976 | A | | 2/1969 | Robinson |
| 3,473,176 | A | | 10/1969 | Taylor |
| 3,811,143 | A | | 5/1974 | Page |
| 3,823,431 | A | | 7/1974 | Miller |
| 3,949,700 | A | | 4/1976 | Baroody |
| 4,033,280 | A | | 7/1977 | Wood et al. |
| 4,040,693 | A | | 8/1977 | Peterson et al. |
| 4,742,795 | A | | 5/1988 | DePrey et al. |
| 4,883,016 | A | | 11/1989 | Larson |
| 4,945,853 | A | | 8/1990 | Lathers |
| 4,957,056 | A | | 9/1990 | Martin |
| 5,029,348 | A | | 7/1991 | Boren |
| 5,095,843 | A | | 3/1992 | Kobayashi |
| 5,123,372 | A | | 6/1992 | Kobayashi et al. |
| 5,136,963 | A | | 8/1992 | Zuzik |
| 5,143,013 | A | | 9/1992 | Huebner |
| 5,150,663 | A | | 9/1992 | Kobayashi |
| 5,234,364 | A | * | 8/1993 | Ito ..... 440/89 R |
| 5,237,950 | A | | 8/1993 | Abe et al. |
| 5,331,917 | A | | 7/1994 | Magers |
| 5,349,919 | A | | 9/1994 | Douglass |
| 5,355,826 | A | | 10/1994 | Hattori et al. |
| 5,366,028 | A | | 11/1994 | Kobayashi |
| 5,416,670 | A | | 5/1995 | Authier |
| 5,490,474 | A | | 2/1996 | Ikeda |

(List continued on next page.)

*Primary Examiner*—Stephen Avila
(74) *Attorney, Agent, or Firm*—BRP Legal Services

(57) ABSTRACT

A watercraft is described with a powered hull and deck. The deck includes a forward passenger area and a rearward passenger area connected by a passageway. A windshield extends upwardly from the deck at a position forward of the rearward passenger area. An engine is positioned within the hull behind the rearward passenger area. An engine cover covers the engine and at least one compartment adjacent to the engine. The compartment is separated from the engine by a removable wall. The compartment houses at least a portion of a canopy system that may be erected over at least a portion of the rearward passenger area of the boat. The watercraft includes a rear bench that conceals a storage bucket thereunder. A console sits in front of a passenger seat with a console cover, which is hingedly mounted to the console to conceal a sound system.

60 Claims, 26 Drawing Sheets

U.S. PATENT DOCUMENTS 5,497,724 A 3/1996 Brown et al.
5,520,139 A * 5/1996 King et al. ..... 114/361
5,537,948 A 7/1996 Kobayashi
5,566,637 A 10/1996 Benza
5,572,944 A 11/1996 Slikkers et al.
5,605,480 A * 2/1997 Wright ..... 440/43
5,619,950 A * 4/1997 Ikeda ..... 114/363
5,697,320 A * 12/1997 Murray ..... 114/361
5,915,329 A 6/1999 Watkins et al.
6,062,922 A 5/2000 Nanami
6,071,156 A 6/2000 Platzer et al.
6,158,378 A * 12/2000 Tsumiyama et al. ..... 114/363
6,168,481 B1 1/2001 Mardikian
6,213,824 B1 * 4/2001 Small ..... 440/68
6,236,826 B1 5/2001 Kurz et al.

* cited by examiner

WATERCRAFT

This application relies on U.S. Provisional Patent Application Ser. No. 60/308,853, entitled "BOAT," which was filed on Aug. 1, 2001, for priority. That application is incorporated herein by reference.

FIELD OF THE INVENTION

The present invention relates to the deck layout for a boat. More specifically, the present invention concerns the deck layout for a sport boat.

BACKGROUND OF THE INVENTION

The prior art is replete with examples of different types of boats that range from those that are designed for more leisurely travel to those that are designed for more sporty travel. Boats designed for leisure generally include yachts and other types of boats that are provided with a cabin or enclosed compartment for the boat's occupants. Boats designed for sportier activities generally do not incorporate a cabin or enclosed passenger space, because such boats typically are limited in their construction by constraints placed upon the total weight of the vehicle.

Sport boats are characterized by a number of features common to that vehicle's genre. In particular, sport boats are designed to travel across the water's surface at high speed. To accomplish this, sport boats incorporate powerful engines connected to propulsion devices such as jet propulsion units. A jet propulsion unit incorporates an impeller housed at the rear of the vehicle. The impeller draws water through a water passage under the vehicle, pressurizes the water, and discharges the water from the rear of the vehicle to propel the vessel.

Because sport boats are capable of generally greater speeds than leisure craft, they are often used for a number of different sporting activities such as water skiing, wake boarding, knee boarding, etc. However, because sport boats traditionally have been designed to maximize speed and maneuverability while minimizing deck space (thereby minimizing boat weight), there has been little emphasis placed on providing sufficient storage for the equipment used for such activities. As a result, a need has developed for a sport boat with increased accessibility to a storage space, especially for accessibility to a space (or spaces) large enough to hold sporting equipment such as water skis, wake boards, knee boards, and fishing poles, among other types of equipment.

In addition, because sport boats are designed with higher speeds in mind, there are often designed with an "open deck." An open deck boat is one where the entire deck of the boat may be viewed from the exterior of the vessel. In other words, there is no internal cabin or enclosed space within the boat where riders may retire in shade (or be protected from the elements, such as rain). Since sport boats are designed primarily with speed and maneuverability in mind, the addition of shade features, such as canopies, traditionally has been antithetical to sport boat design, because the additional structure either adds weight to the vehicle or provides further drag when the vehicle is in motion. However, a need has developed for the design of a sport boat that can provide at least modest protection for riders from the elements without detracting from the speed, maneuverability, or appearance of the sport boat.

Another failing in the prior art concerns the positioning of the components that are connected to and support the engine. In particular, for a sport boat incorporating a jet propulsion unit, common wisdom suggests that the resonator canister(s) should be disposed substantially horizontally within the hull. This does not facilitate removal of water that may accumulate with the resonator canister(s), a condition that may affect adversely the performance of the watercraft. Accordingly, a need has developed for a component layout that facilitates removal of water from the resonator canister (s).

Some sport boats also suffer from at least one additional failing in the prior art. In particular, some sport boats traditionally incorporated a large, curved transition between the rear transom of the watercraft and the bottom of the hull (the running surface of the boat). Such a large, slowly-sweeping transition creates a large radius of curvature between the rear of the vessel and the operative surface at the bottom of the hull, which, in some cases, adversely affects the operation of the vessel. Specifically, the large radius of curvature results in increased drag on the hull. Accordingly, a need has developed for a hull design that minimizes drag on the hull at the transition between the transom at the stern of the vessel and the operating surface beneath the hull.

As a rule, conventional sport boats that include a windshield or other type of windowed windscreen do so at the expense of visibility to the driver. In particular, the sides of the windshield often extend upwardly from the gunwales of the boat the same distance as the forward-most portion (or front) of the windshield. Accordingly, if the driver were to look sideways (e.g., to spot a water skier, another boat, or an obstacle), the operator often found that he or she had to stand to look over the upper frame of the side sections of the windshield. Accordingly, a need has developed for an improved windshield design, in particular, one that does not interfere with the operator's line of sight when the operator looks either to the port or starboard sides of the vessel, especially when the driver is seated.

It is known to include electronic equipment, such as a sound system, on a variety of different boat types including sport boats. Just as with any other vehicle (and perhaps even more so with a boat having an open deck construction), security for the sound system is important. In particular, the sound system should be designed with an anti-theft device to prevent, or at least deter, theft of the radio, CD player, or other sound equipment placed on the vessel.

It is also common to place the sound equipment on the console in front of the passenger's seat on the boat (when such a console is provided). The passenger's seat is typically the seat adjacent to the driver's seat but on the opposite side of the boat. In some boat designs, the driver's seat and the passenger's seat are positioned in front of a bench seat that extends across the rear of the vessel from the port to starboard sides.

In the case where the sound system is positioned on the console in front of the passenger's seat, the sound system is usually exposed and visible from the exterior of the vessel. Positioned in this manner, the sound system is a particularly attractive nuisance to the average radio thief. What the prior art lacks is a reliable security device or system that either reduces or eliminates the theft potential for the sound system aboard vessels with an open deck.

One further failing in the prior art lies concerns the storage of a collapsible table that may be erected in the passenger area. It is known to provide a collapsible table for the passenger areas of some boats. However, the storage of such tables has not been addressed.

Still further, the prior art fails to provide foot rest areas for passengers that can accommodate a variety of foot positions and/or different heights of individuals.

Each of these failings in the prior art has been identified by consumers recently as areas where solutions are either desired or needed.

SUMMARY OF THE INVENTION

In view of the foregoing, it is an aspect of the present invention to provide an improved sport boat that provides at least one of the features described in greater detail below.

Accordingly, it is at least one aspect of the present invention to provide a sport boat with increased storage capacity such that the vessel includes compartments at least for the storage of large sporting equipment such as water skis, wake boards, and knee boards, among others.

In one embodiment, it is an aspect of the present invention to provide a storage compartment beneath a rear bench of the sport boat. The rear bench is divided into one or more removable sections that, when lifted from above the storage compartment, expose the storage compartment.

It is another aspect of the present invention to provide a storage compartment beneath the rear bench of the sport boat such that the storage compartment extends nearly the entire width of the vessel.

Accordingly, one aspect of the present invention is to provide a boat with a powered hull defining lateral and longitudinal directions. A deck is disposed above the hull. A storage compartment is provided in the deck. The storage compartment extends laterally across a substantial width of the hull and is substantially larger in the lateral direction than in the longitudinal direction.

It is still a further aspect of the present invention to provide a storage compartment at the rear of the sport boat beneath the cover above the engine compartment. In particular, it is an object of the present invention to provide a storage compartment astride the engine within the engine compartment.

To facilitate placement of a storage compartment astride the engine at the stern of the vessel, it is an object of the present invention to provide a removable wall adjacent the engine to separate the engine from the spaces laterally adjacent the engine. The wall helps to define the storage spaces laterally adjacent to the engine. However, the wall is removable to permit access to the sides of the engine.

Accordingly, one aspect of the present invention is to provide a boat with a hull having a transom. An engine for propelling the boat is mounted to the hull forward of the transom. A storage compartment is positioned on the hull on a lateral side of the engine. A removable wall portion is disposed between the engine and the storage compartment. The removal of the wall portion facilitates access to the engine through the storage compartment.

It is another aspect of the present invention to provide a sport boat that incorporates a deployable sunshade, such as a canopy. Preferably, the sunshade is easily stowed within the engine compartment so that it does not adversely impact on the aesthetic appearance of the vessel. In addition, preferably, the sunshade is easily deployed from its stowed position without the need to assemble and attach complex, rigid supports to the deck.

To this end, one aspect of the present invention is to provide a sport boat with a sun shade (e.g., a canopy) that may be folded and stowed on the sport boat without having to detach the canopy supports from the sport boat.

The present invention provides a boat with a hull and a deck. Port and starboard gunwales define port and starboard sides. A canopy system is provided that includes starboard and port longitudinally extending slide rails mounted to the starboard and port gunwales, respectively. The canopy system includes a canopy support having a starboard end pivotally and slidably mounted to the starboard slide rail and a port end pivotally and slidably mounted to the port slide rail. It also includes a canopy mounted to the canopy support. The canopy system is selectively movable between raised and stowed positions. Moreover, when the canopy system is in the stowed position, a middle portion of the canopy support is concealed from view. When the canopy system is in the raised position, the middle portion of the canopy support is disposed above the deck.

One other aspect of the present invention is to provide a hull design that minimizes drag at the transition between the transom and the operational surface on the bottom of the hull. In one preferred embodiment, a surface is provided that is disposed at an angle of forty-five degrees to the bottom surface of the hull and to the transom that acts as an intermediate surface between these two surfaces and that minimizes drag.

Accordingly, the present invention provides a boat having a hull with a bottom exterior side that defines a running surface and a stern exterior side. An engine is disposed within the hull. An intersecting surface extends between the bottom exterior side and the stern exterior side. The intersecting surface forms a predetermined angle with respect to the bottom exterior side.

A further aspect of the present invention is to provide a sport boat with a windshield that does not interfere with the driver's side vision. In other words, the present invention improves the driver's field of vision on both the starboard and port sides of the vessel.

Accordingly, one aspect of the present invention is to provide a windshield that extends to a height on the sides of the vessel that is less than the height of the windshield at the front of the vessel.

The present invention provides a boat with a hull having side gunwales. The engine is disposed within the hull for propulsion. A control console is operatively connected to the engine to control the engine. A driver's seat is disposed on the hull behind the control console. A front windshield is mounted to the hull and extends upwardly a predetermined height from the hull in front of the driver's seat for protection of a driver from wind. Port and starboard side windshields are adapted to provide a windscreen for the driver. The side windshields extend upwardly from the gunwales with forward ends of the side windshields being connected to the front windshield. The side windshields extend rearwardly behind the driver's seat when the driver's seat is in a driving position. The tops of the side windshields are disposed below the predetermined height of the front of the windshield, improving the field of visibility for the driver.

Another aspect of the present invention is to provide a console cover at least on the console in front of the passenger seat. The console cover may be raised to expose the radio or sound system therebeneath. Since the cover can be closed, the cover provides additional security protection for the radio or sound system components covered thereby.

Because the cover may extend across the console in front of the passenger's seat under a windshield (in the boat design where a windshield is included), the console cover is hinged to the console so that it swings outward and upward when opened. Accordingly, one object of the present invention is to provide a hinge assembly that permits the console cover to be opened without interfering with the windshield disposed above it.

A further aspect of the present invention is to provide an improved positioning for the engine components, in particular, the muffler(s) or resonator canister(s). More specifically, in one example, the resonator canister(s) are positioned to facilitate draining of water that may accumulate therein.

Accordingly, one aspect of the present invention is to provide a boat with a hull, a deck disposed above the hull, and a transversely extending transom. An engine is mounted in the boat for propulsion of the boat, the engine having an exhaust port. At least one resonator canister is operatively connected to the exhaust port of the engine and is disposed in front of the transom. The resonator canister exhausts to an external side of the hull. The resonator canister is mounted in front of the transom such that one end is lower than the other.

It is still another aspect of the present invention to provide a table that may be disposed in the passenger area of the watercraft and to provide a convenient location for the storage of the table, once collapsed.

One further aspect of the present invention is to provide a foot rest area that provides for different foot positions and accommodates individuals of different heights.

The list of features of the present invention is not meant in any way to limit the scope of the present invention. The scope of the present invention is set forth in the description that follows.

BRIEF DESCRIPTION OF THE DRAWINGS

Examples of the objects of the present invention are shown in the drawings appended hereto, like reference numbers indicating like parts throughout. In the drawings.

DETAILED DESCRIPTION OF THE PREFERRED EMBODIMENTS OF THE INVENTION

Throughout the drawings of the present invention, reference will be made to like elements. Where appropriate, like elements will be given the same reference designation.

Figure 1:
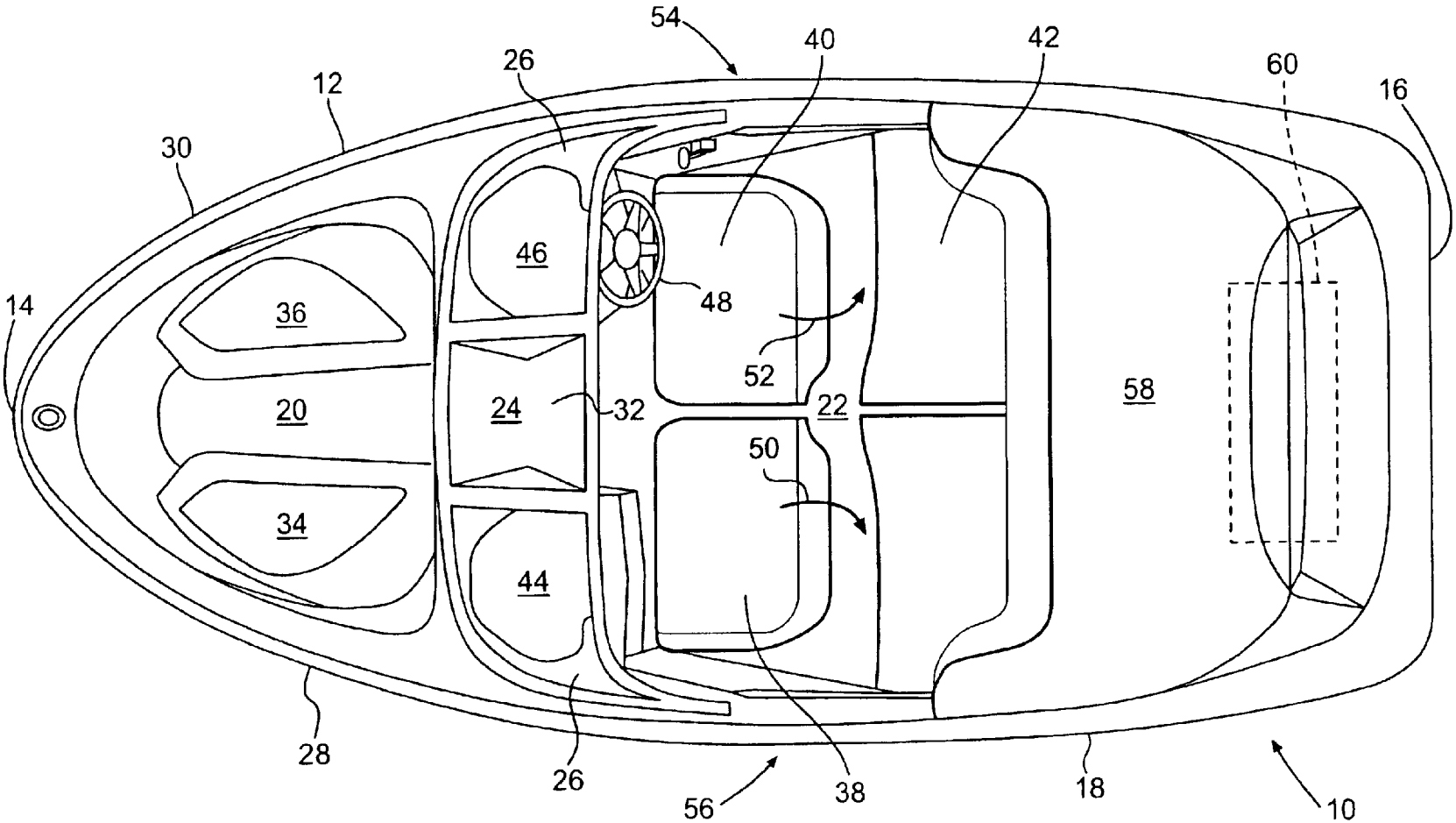
FIG. 1 is a top view of a watercraft incorporating at least one of the features of the present invention.

FIG. 1 is a top view of the watercraft 10 of the present invention. While the watercraft 10 is depicted with a specific configuration, as described more fully below, those skilled in the art will appreciate that one or more of the aspects of the present invention may be incorporated into a watercraft, regardless of the particular configuration and layout. In other words, aspects of the present invention are intended for use on watercraft and are not limited solely to the watercraft 10 depicted and described.

The watercraft 10 includes a hull 12 with a bow 14 and a stern 16. The layout of the deck 18 includes a forward passenger area 20 and a rearward passenger area 22. The forward passenger area 20 is connected to the rearward passenger area 22 by a passageway 24. A windshield 26 extends from the port side 28 to the starboard side 30 of the watercraft 10. When the watercraft 10 is at rest (i.e., motionless), a center section 32 of the windshield 26 is openable to permit riders to move about on the deck 18 from the forward passenger area 20 to the rearward passenger area 22. When the watercraft 10 is in motion, the center section 32 of the windshield 26 may be closed to provide a wind screen for the riders in the rearward passenger area 22.

The center section 32 preferably is hingedly mounted to the remainder of the windshield 26 on either the port or starboard sides 28, 30. If the hinge is positioned on the port side 28 of the center section 32 of the windshield 26, the center section 32 will fold outwardly against the port side 28 of the windshield 26 when opened. If the hinge is positioned on the starboard side 30 of the windshield 26, the center section 32 will fold over onto the starboard side 30 of the windshield 26 when opened. Alternatively, the center section 32 of the windshield 26 may be removable altogether. In addition, while a center section 32 is preferred for the windshield 26, the center section 32 is not required to practice aspects of the present invention.

The illustrated watercraft 10 is rated to accommodate eight passengers. In the forward passenger area 20, there are two seats, a forward port seat 34 and a forward starboard seat 36. Both the forward port seat 34 and the forward starboard seat 36 preferably are integrally molded as part of the deck 18. Both seats 34, 36 are designed to accommodate one adult-sized rider. The rearward passenger area 22 includes a port buddy seat 38 and a starboard buddy seat 40. The buddy seats 38, 40 are so named because they are designed to accommodate two adult-sized riders each. A bench 42, which is also an integral part of the deck 18, is positioned behind the two buddy seats 38, 40 and is designed to accommodate up to four adult-sized riders.

In FIG. 1, the buddy seats 38, 40 are shown in the driving position. In other words, the buddy seats 38, 40 are shown in a forward-facing position behind the port console 44 and the starboard console 46. The starboard console 46 includes a steering wheel 48. As indicated in FIG. 1, the port buddy seat 38 is rotatable in the direction shown by arrow 50. Similarly, the starboard buddy seat 40 is rotatable in the direction indicated by arrow 52.

When the watercraft 10 is at rest, the buddy seats 38, 40 may be rotated approximately 90 degrees from a driving position to a relaxed position so that the back rests for the seats 38, 40 abut against the port and starboard gunwales 56, 54 of the watercraft 10. When the seats 38, 40 are rotated to the relaxed position, the seats 38, 40 mate with the bench seat 42 at the rear of the rearward passenger area 22 to form a substantially contiguous seating area. In addition, when the seats 38, 40 are rotated against the gunwales 54, 56 and the center portion 32 of the windshield 26 is opened, riders may move freely from the forward passenger area 20 to the rearward passenger area 22 and vice versa. In addition, when the buddy seats 38, 40 are rotated against the gunwales 54, 56, the rearward passenger area 22 is maximized in terms of its useable space.

While the buddy seats 38, 40 are preferred for the watercraft 10 of the present invention, the buddy seats 38, 40 are not required. Instead, prior art bucket seats may be substituted therefor. If buckets seats are incorporated into the driver's and passenger's positions, the overall capacity of the sport boat 10 is reduced by two passengers since bucket seats are designed to accommodate only one adult-sized rider.

Figure 2:
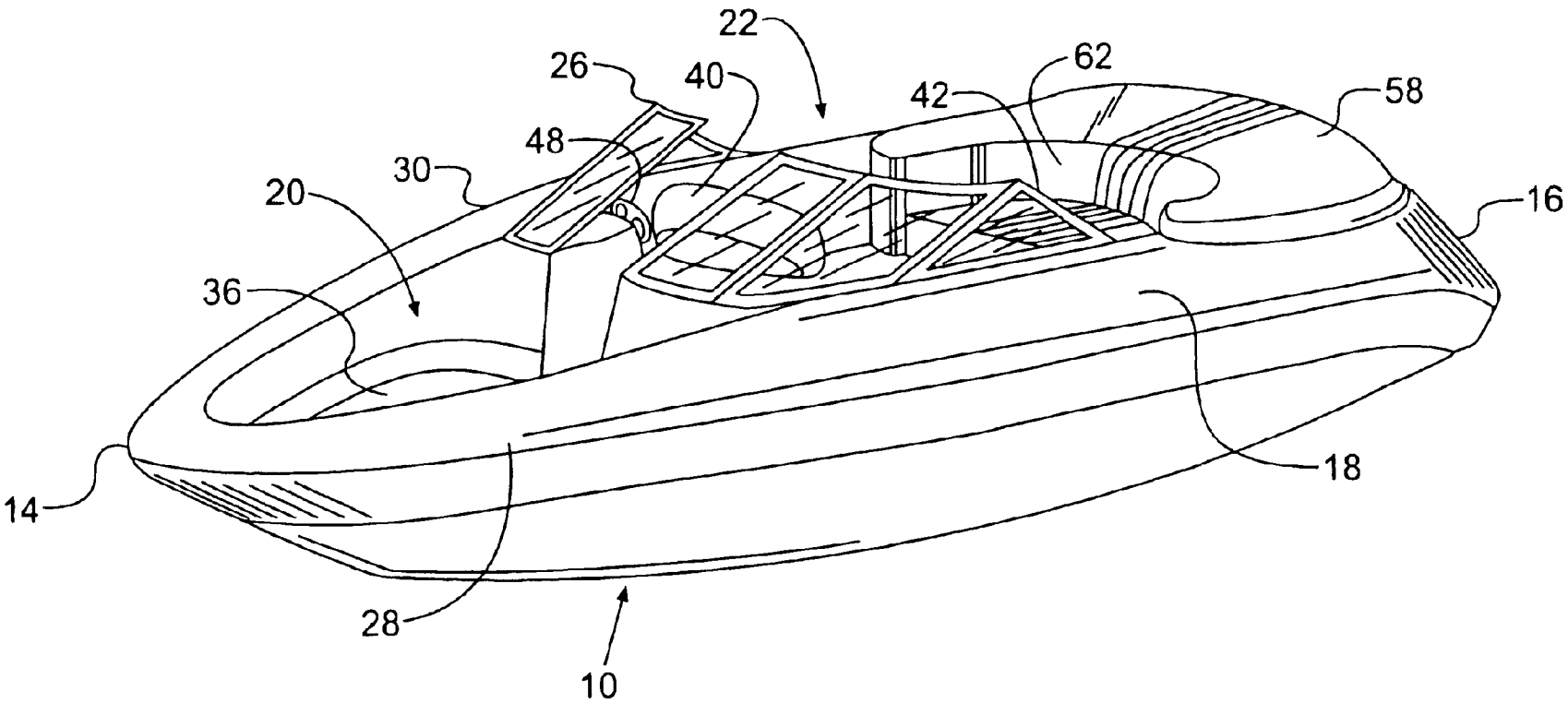
FIG. 2 is a perspective illustration of the boat shown in FIG. 1.

An engine cover 58 is disposed at the stern 16 of the watercraft 10 behind the bench seat 42. FIG. 2 illustrates the engine cover 58 in a closed position where the cover 58 encloses the engine 60 and other peripheral features at the stern 16 of the watercraft 10. Preferably, the watercraft 10 is powered by an internal combustion engine 60. The internal combustion engine may be either of the two or four stroke variety. As would be appreciated by those skilled in the art, the engine 60 need not be an internal combustion engine, but any alternative engine 60 may be substituted therefor without deviating from the scope of the present invention. For example, the engine 60 could be replaced by an electrically-driven motor powered by batteries or a fuel cell.

While not illustrated, the watercraft 10 preferably is powered by a jet propulsion unit. The jet propulsion unit is disposed at the stern 16 of the watercraft in the same general location as the engine 60. The jet propulsion unit is designed to draw water from underneath the hull 12 of the watercraft, pressurize the water (by an impeller), and discharge the water at great pressure through a jet port at the stern 16 of the watercraft 10. While a jet propulsion unit is the preferred choice for propelling the watercraft 10, those skilled in the art would appreciate that the watercraft 10 could be propelled alternatively with a propeller driven by an inboard internal combustion engine or by one or more outboard propeller motor.

Figure 3:
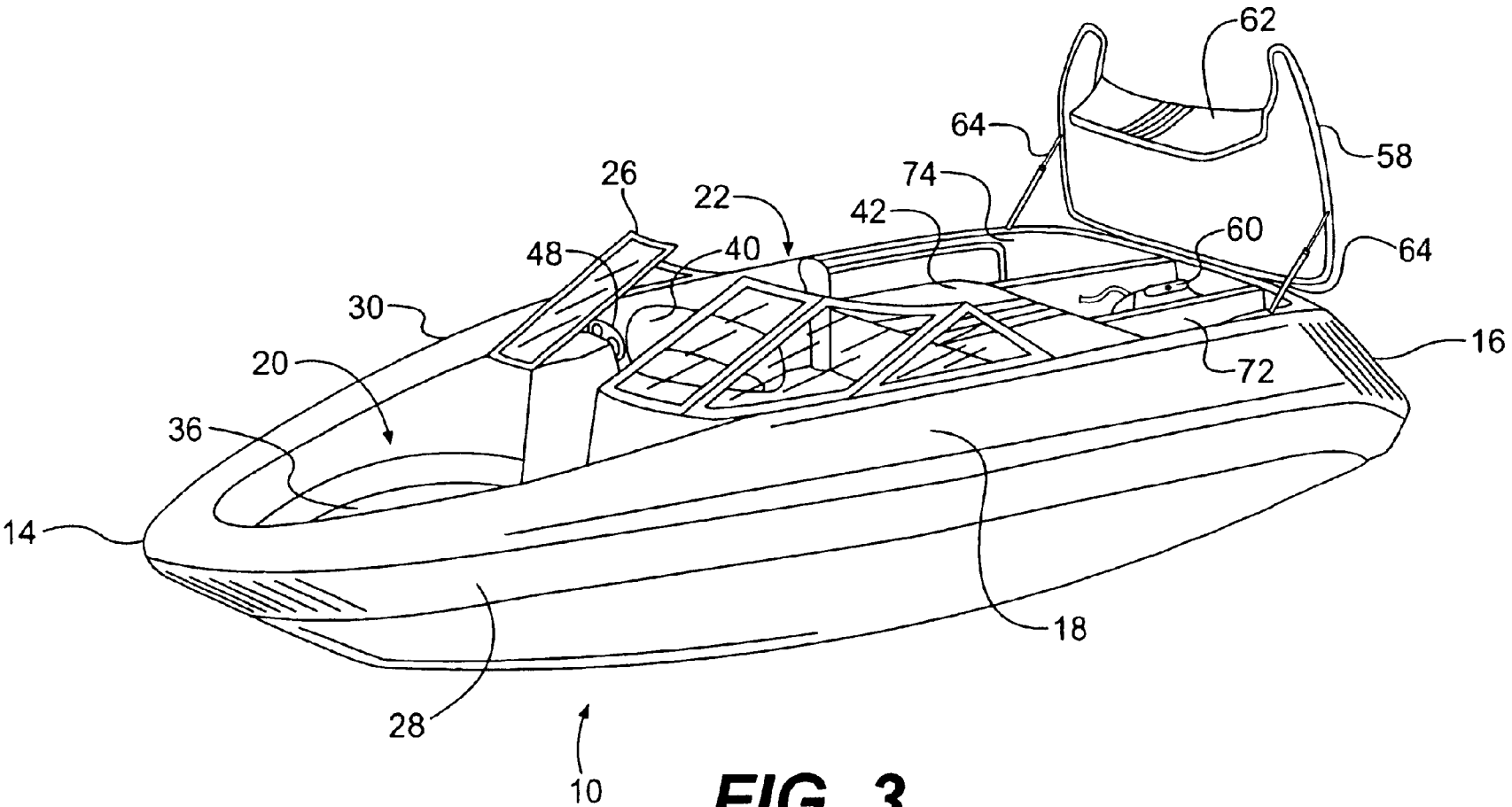
FIG. 3 is a perspective view of a boat incorporating one or more aspects of the present invention, the illustration showing the engine cover of the watercraft in an open position.
Figure 4:
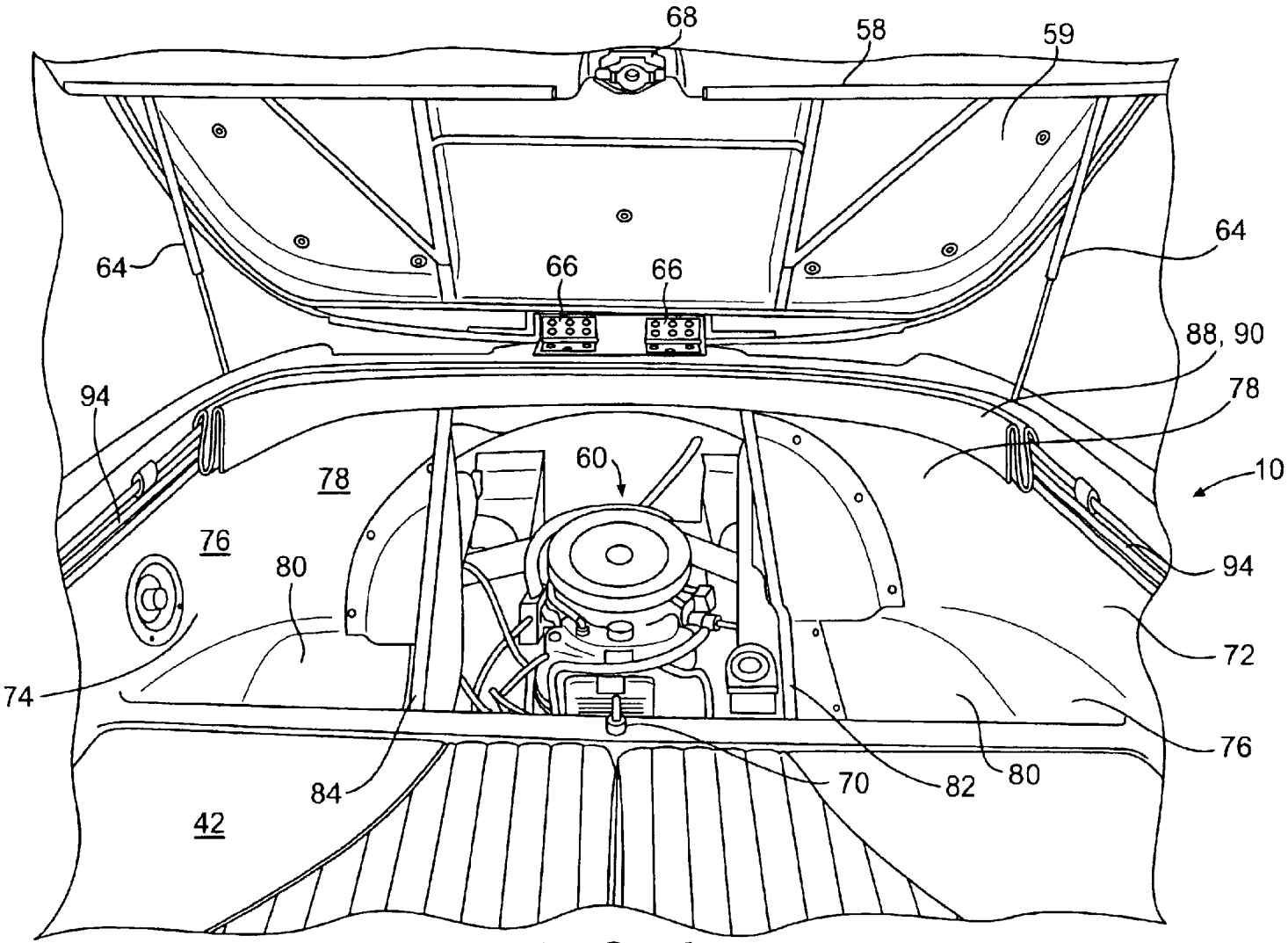
FIG. 4 is a partial perspective illustration of a portion of the watercraft illustrated in FIG. 1, the view being from the rearward passenger area looking toward the rear of the boat with the engine cover opened.

As illustrated in FIGS. 2–4, the engine cover 58 preferably forms the back rest 62 for the rear bench seat 42. As shown in detail in FIG. 4, the engine cover 58 preferably is mounted with one or more hinges 66 to the stern 16 of the watercraft 10 above the engine 60. When opened, the engine cover 58 preferably is held upright by one or more pistons 64.

In the embodiment illustrated, it is anticipated that the engine cover 58 will be manually opened by releasing a latch 68 beneath the cover 58. When closed, the latch 68 engages a pin 70 disposed on the deck 18 behind the bench seat 42. Alternatively, the engine cover 58 need not be constructed such that it is opened manually. Instead, the engine cover 58 could be constructed so that it is opened electromechanically from a switch, which may be disposed on either the port or starboard control consoles 44, 46, for example.

As also shown in FIGS. 3–6, the engine cover 58 covers not only the engine 60, but it also covers port and starboard storage compartments 72, 74. The port and starboard storage compartments 72, 74 straddle the engine 60 on either side.

Figure 5:
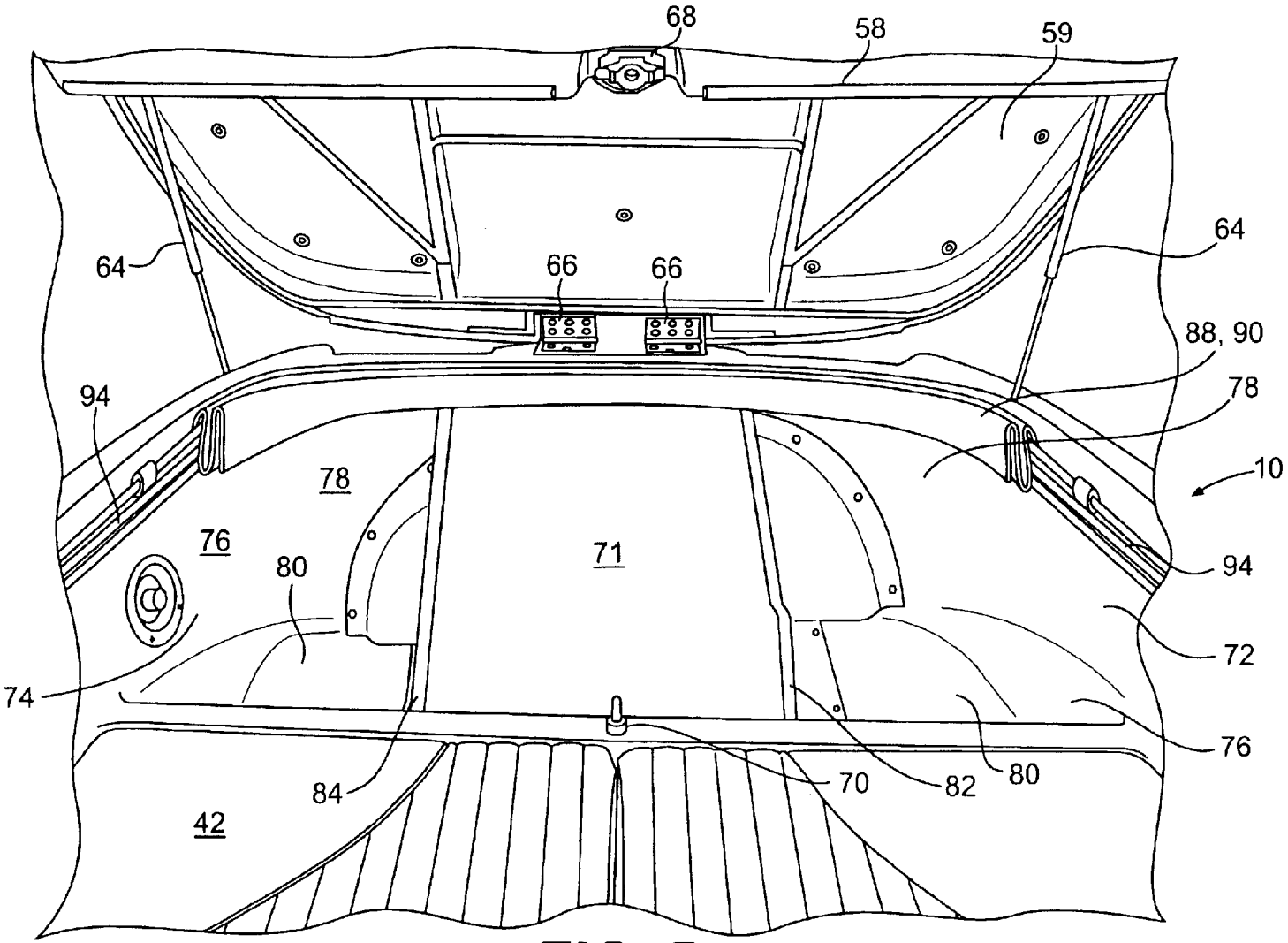
FIG. 5 is another partial perspective illustration of a portion of the watercraft illustrated in FIG. 1, the view being from the rearward passenger area looking toward the rear of the boat with the engine cover opened, the perspective illustrating the position of a secondary engine cover in a closed position.
Figure 6:
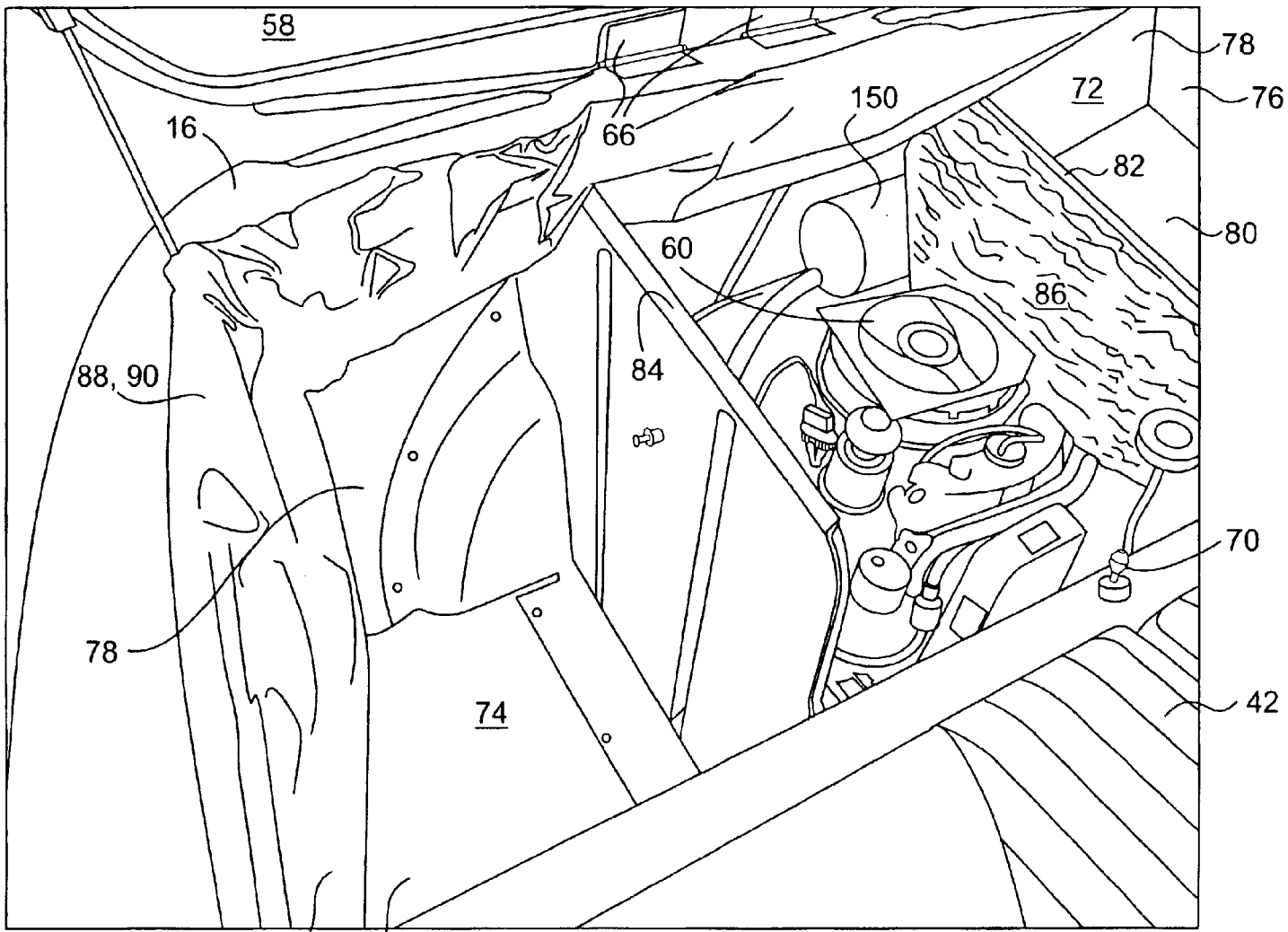
FIG. 6 is another partial perspective illustration of the watercraft illustrated in FIG. 1, the view looking toward the port side of the watercraft from a vantage point in the rearward passenger area near the starboard stern of the watercraft.

As illustrated best in FIGS. 4–6, the lateral sides 76, rear sides 78, and bottoms 80 of both of the storage compartments 72, 74 preferably are integrally molded as part of the deck 18. As would be understood by those skilled in the art, however, the storage compartments 72, 74 need not be integrally molded with the deck 18. Instead, they may be provided as inserts into the deck 18.

Port and starboard wall inserts 82, 84 separate the port storage compartment 72 and the starboard storage compartment 74 from the engine 60. Preferably, the port and starboard wall inserts 82, 84 are constructed from a lightweight plastic material and are fastened to the deck 18 with bolts or other suitable, removable fasteners. In addition, the wall inserts 82, 84 are preferably fitted with a reflective and insulative material 86 on the side facing the engine 60, which prevents the heat generated by the engine 60 from adversely affecting the items stored in either of the compartments 72, 74.

As shown in FIG. 5, a secondary engine cover 71 may be positioned above the engine 60, extending between the port and starboard wall inserts 82, 84. With such a construction, upon opening the engine cover 58, the engine 60 would not be accessible immediately. The secondary engine cover 71 would be required to be removed (or opened) to provide access to the engine 60. It is contemplated that the secondary engine cover 71 could be pivotally attached to the port or starboard wall inserts 82, 84, or the rear side 78 of the engine compartment. It is also contemplated that the secondary engine cover 71 could be provided with one or more depressions for storage of items above the engine 60. For example, the secondary engine cover 71 could be provided with a storage area for tools or a first aid kit, among other items.

The port and starboard wall inserts 82, 84 preferably are easily removed from the positions illustrated in FIGS. 4–6. When removed, access to the engine 60 is greatly facilitated. While screws or bolts are preferred to removably fasten the wall inserts 82, 84 adjacent to the engine, any suitable fastener may be used as would be understood by those skilled in the art.

Figure 7:
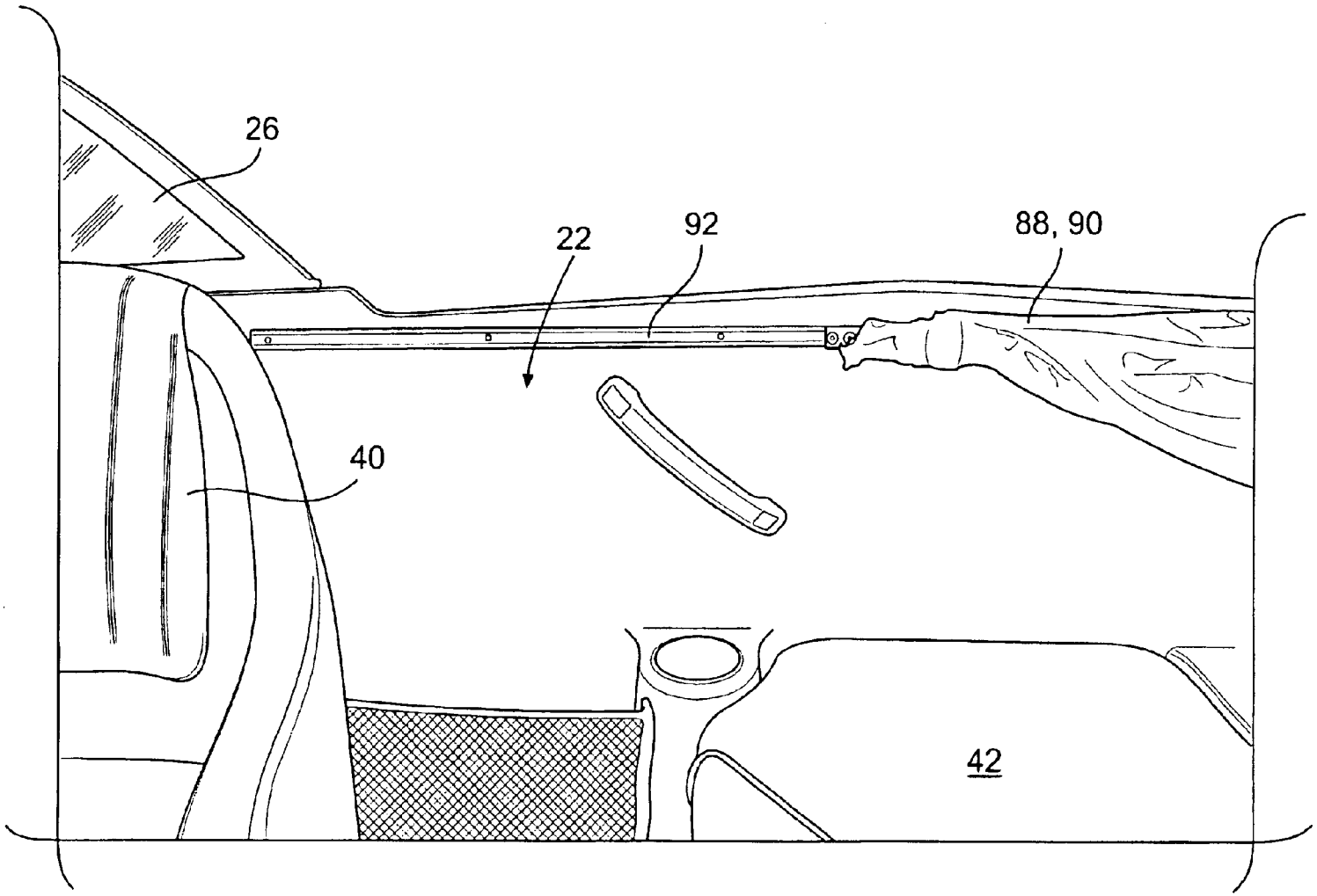
FIG. 7 is a partial perspective view of the interior of the watercraft illustrated in FIG. 1, the view facing the starboard side of the watercraft from a vantage point within the rearward passenger area of the watercraft.
Figure 8:
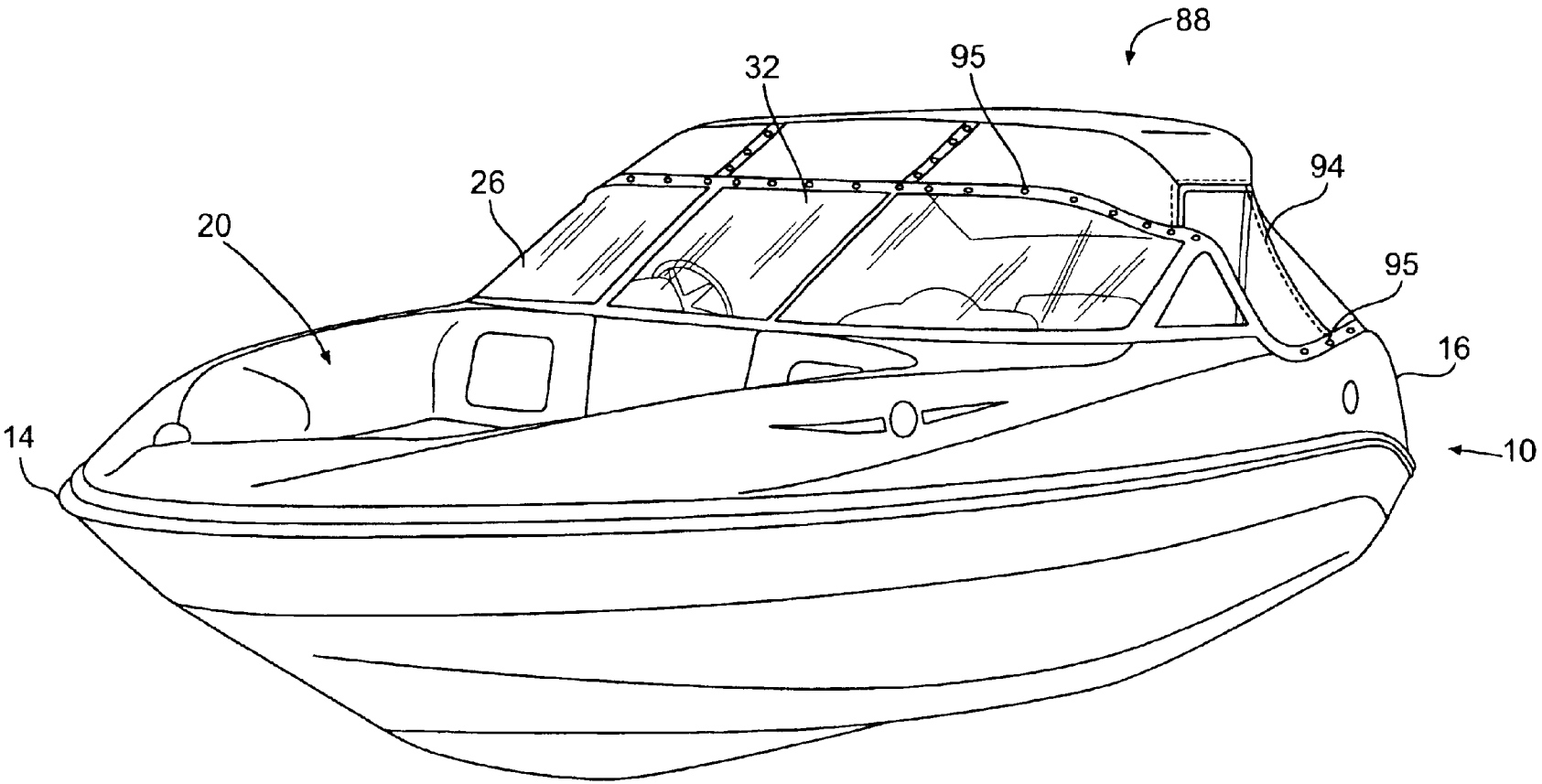
FIG. 8 is a perspective illustration of the watercraft shown in FIG. 1 fitted with a first embodiment of a canopy, known as a "convertible canopy"
Figure 9:
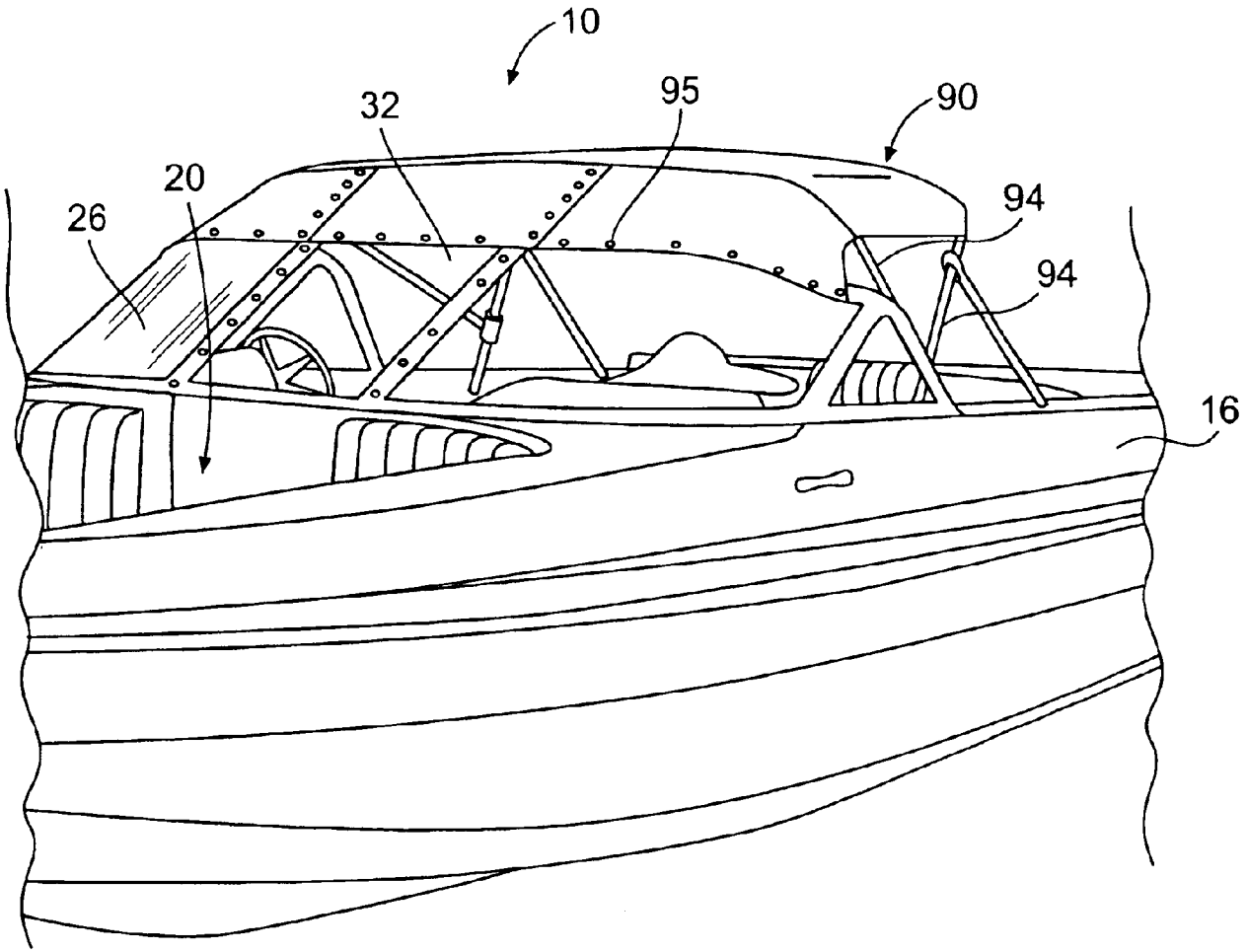
FIG. 9 is a perspective view of a portion of the watercraft, depicting the convertible canopy illustrated in FIG. 8, shown here with the protective side and rear panels removed.
Figure 10:
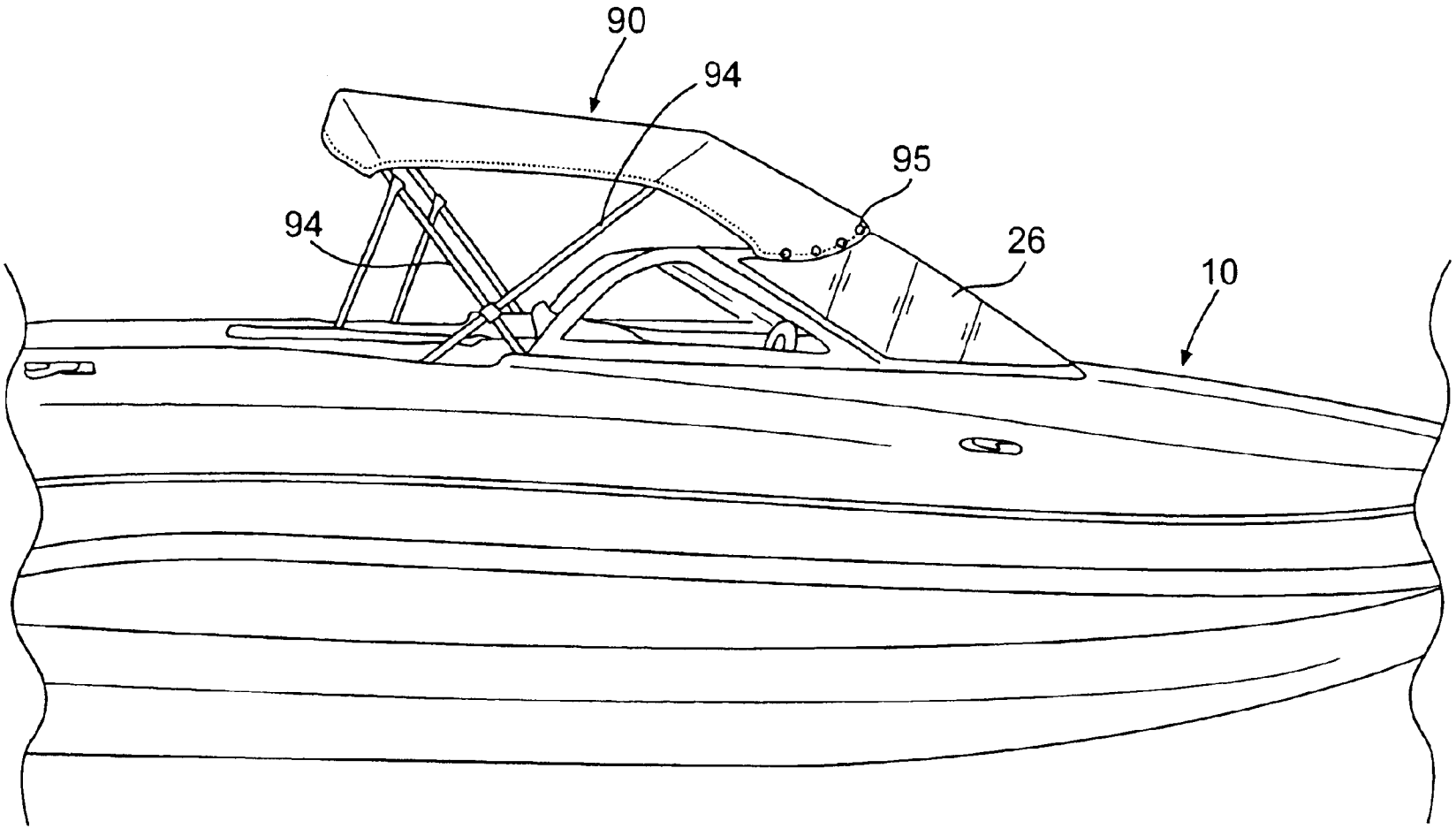
FIG. 10 is a side view of a portion of the watercraft, showing the convertible canopy of FIGS. 8 and 9 from a side perspective.
Figure 11:
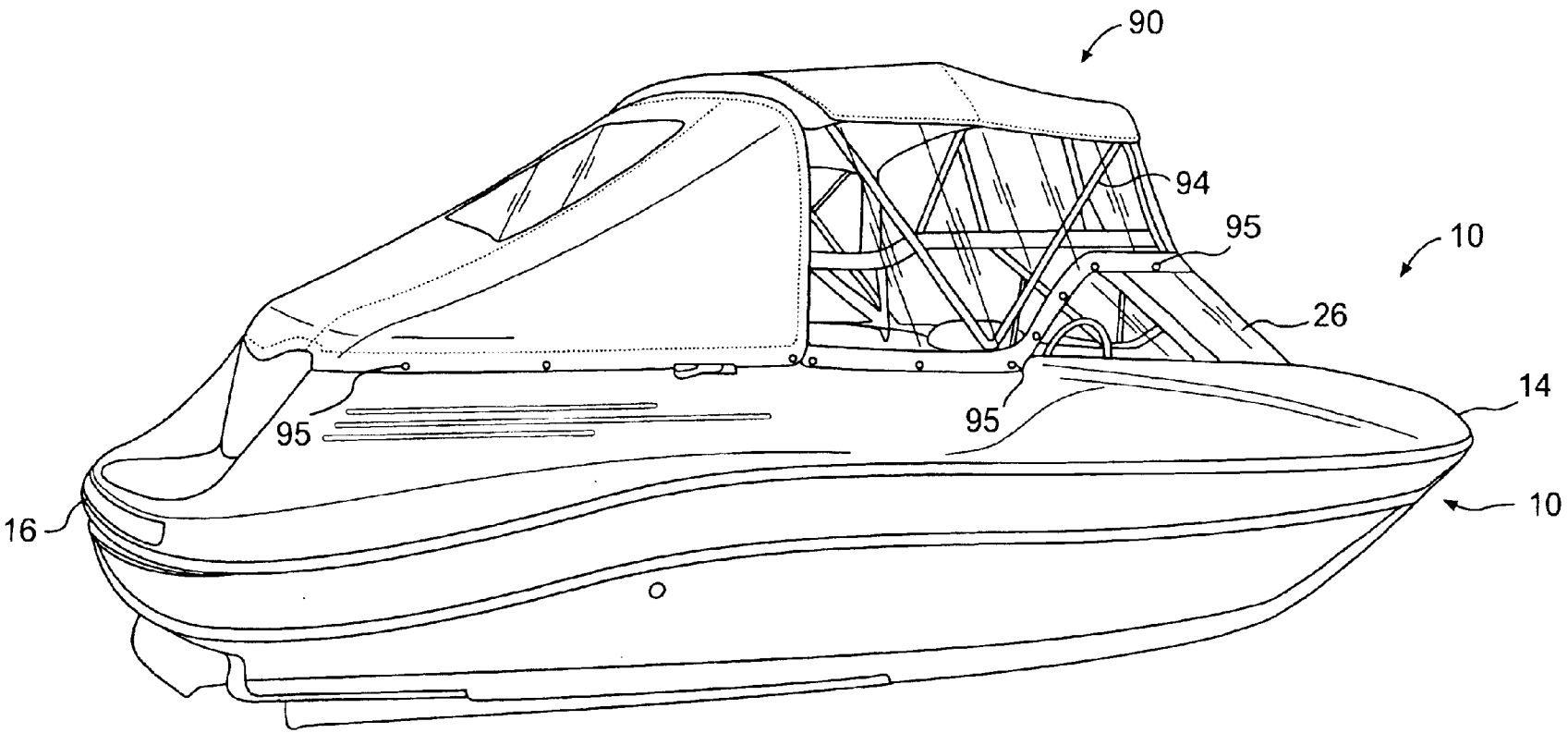
FIG. 11 is a perspective illustration of the watercraft shown in FIG. 1 fitted with a second embodiment of a canopy known as a "bimini canopy," which provides a greater amount of headroom than the "convertible canopy" embodiment illustrated in FIG. 8.

FIGS. 4–5 and 7–10 illustrate various aspects of two canopy options contemplated for use on the watercraft 10 of the present invention. The first canopy option is the "low headroom" option (canopy 88) and is illustrated in FIGS. 8–10. This "low headroom" option is more commonly referred to as a "convertible canopy" 88. The second canopy option is the "high headroom" option (canopy 90) illustrated in FIG. 11. This "high headroom" option is more commonly referred to as a "bimini canopy" 90.

Both the convertible canopy 88 and the bimini canopy 90 serve the same purpose. Specifically, both canopies 88, 90 protect riders in the rearward passenger area 22 from the elements, such as sunshine or rain. Alternatively, the canopies 88, 90 may be used to protect the watercraft 10 when it is not in used but is docked.

Both canopies 88, 90 are designed to store easily within the deck 18 of the watercraft 10. Specifically, as illustrated in FIGS. 4 and 5, the canopy 88, 90 folds to be compactly stored beneath the engine cover 58.

To facilitate the storage and deployment of canopy 88 or 90, the watercraft 10 incorporates slide rails 92 on either side of rearward passenger area 22. The slide rails 92 accommodate the supporting braces 94 for the canopy 88, 90. The supporting braces 94 are pivotally and slidably mounted in the slide rails 92, as shown in FIG. 7. Preferably, at least one supporting brace 94 is provided to support the canopy 88, 90, as illustrated in FIGS. 4 and 5. As may be appreciated from the drawings, the supporting brace(s) 94 are U-shaped and extend from the slide rail 92 on one side of the rearward passenger area 22 to the slide rail 92 on the other side.

When not in use, the canopy 88, 90 folds so it can be conveniently stored beneath the engine cover 58, as illustrated in FIGS. 4 and 5. When needed, the canopy 88, 90 may be deployed from its storage position beneath the engine cover 58. One particular advantage offered by the design of the canopy 88, 90 and the slide rails 92 lies in the fact that the canopy 88, 90 may be folded and stored beneath the engine cover 58 without the need for detaching the supporting brace(s) 94 from the slide rails 92. This greatly facilitates deployment and storage of the canopy 88, 90.

As FIGS. 8–11 illustrate, the canopies 88, 90 are affixed to the deck 18 of the boat and the windshield 26 through conventional snap fasteners 95 so that canopies 88, 90 may be quickly erected and/or prepared for storage beneath the engine cover 58. As would be appreciated by those skilled in the art, however, the canopies 88, 90 may be attached to the watercraft 10 using any other suitable means.

In the preferred embodiment of the present invention, the canopies 88, 90 preferable are constructed from a woven material that has been treated to be water resistant or water repellent. As would be appreciated by those skilled in the art, however, any suitable material may be used in place of the preferred woven fabric. For example, a non-woven, water resistant (or water repellent) material may be used.

The interior surface 59 of the engine cover 58 preferably is a finished surface on the watercraft 10. In particular, the interior surface 59 of the engine cover preferably is finished as a "Class A" surface, which is a quality standard typically reserved for an exterior portion of the watercraft 10. Such a finish is preferred for the interior surface 59 of the engine cover 58 because the cover 58 is expected to be opened frequently to access the storage compartments 72, 74 and the canopy 88, 90.

Figure 12:
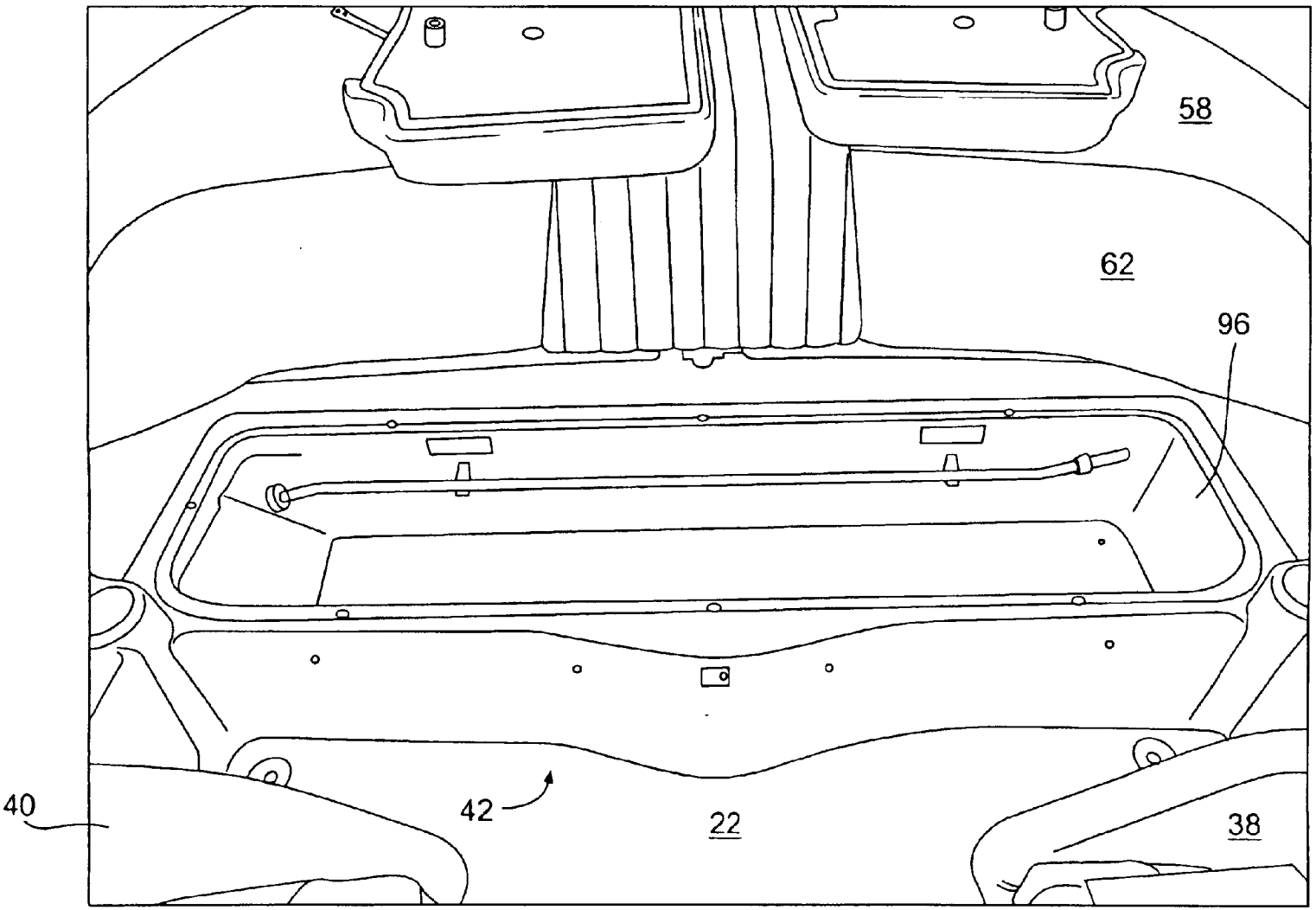
FIG. 12 is a partial perspective view of a storage compartment in the watercraft illustrated in FIG. 1, the storage compartment being located beneath the rear bench seat of the watercraft, the seat cushion(s) of which have been removed in this illustration to show the interior of the storage compartment.

FIG. 12 illustrates a lateral ski bucket storage compartment 96 concealed beneath the cushion(s) of the rear bench seat 42 within the rearward passenger area 22. The lateral bucket 96 extends nearly the full width of the rear bench 42. It also extends nearly the full width of the watercraft 10 at the location of the rear bench seat 42. Preferably, the lateral ski bucket 96 has a lateral length that is at least ¾ of the beam of the sport boat 10. In addition, preferably, the lateral ski bucket 96 has a longitudinal length that is less than half of the compartment's lateral length. So dimensioned, the lateral storage compartment 96 maximizes use of the space beneath the rear bench seat 42. The lateral storage bucket 96 is designed to be large enough to easily accommodate a pair of water skis, a wake board, or similar water sport equipment.

Figure 13:
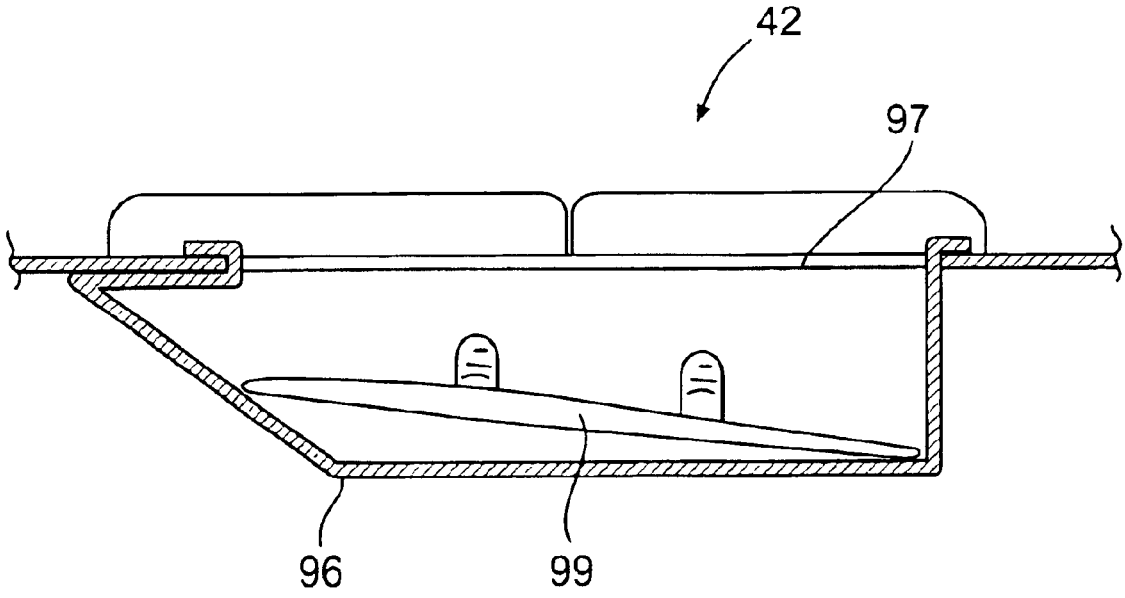
FIG. 13 is a cross-sectional, schematic representation of the storage compartment illustrated in FIG. 12.

A cross-sectional schematic diagram of the lateral storage bucket 96 is provided in FIG. 13. The lateral storage bucket 96 extends beneath the rear bench seat 42 and is positioned within the boat 10 such that one end of the lateral storage bucket 96 extends a greater distance beneath the rear bench seat 42 than the opposite side. The opening 97 into the lateral storage bucket 96, while substantially centered beneath the cushions of the rear bench seat 42, is not laterally co-extensive with the lateral storage bucket 96.

The length of the lateral storage bucket 96 permits storage of items, such as water skis, wake boards, knee boards, and fishing poles, all of which potentially have a length greater than that of the opening 97 beneath the cushions of the rear bench seat 42. Accordingly, if the lateral width of the lateral storage bucket 96 were the same as that of the opening 97, certain items would not fit into the lateral storage bucket 96. FIG. 13 illustrates one particular example. There, a wake board 99, with a length that exceeds the width of the opening 97, has been placed into the lateral storage bucket 96. As may be readily appreciated, if the lateral storage bucket 96 did not have one side that extended a further distance into the hull 12 than the other side, the wake board 99 could not have been stored therein.

While a specific construction for the lateral storage bucket 96 is illustrated in FIGS. 12 and 13, the present invention is not limited solely to such a construction. In particular, the lateral storage bucket 96 is offset from the opening 97 so that its starboard end exceeds the width of the opening 97. While it is believed that this orientation facilitates access to the contents of the lateral storage bucket 96, it is contemplated that the lateral storage bucket 96 could exceed the width of the opening 97 on both the port and starboard sides without departing from the scope of the present invention.

Preferably, the lateral ski bucket 96 is covered by one or more seat cushions that form the seating portion of the bench seat 42 on the watercraft. While not shown in detail, the cushion or cushions preferably are fitted with protrusions on their lower surface that are designed to engage to opening 97 to the lateral ski bucket 96. As a result, the seat cushion(s) above the lateral ski bucket 96 may be removed and replaced with minimal effort.

While the lateral ski bucket 96 is preferably integrally molded as part of the deck 18 of the watercraft 10, those skilled in the art would readily appreciate that the body of the lateral ski bucket 96, including the front, rear, port, starboard, and bottom sides, may be molded separately from the deck 18 of the watercraft and inserted into the deck 18 during manufacture. Additionally, the lateral ski bucket 96 need not be installed permanently within the deck 18. Instead, the lateral ski bucket 96 may be removable to provide access to the electrical and mechanical systems within the watercraft 10. This embodiment is illustrated in FIG. 13.

Figure 14:
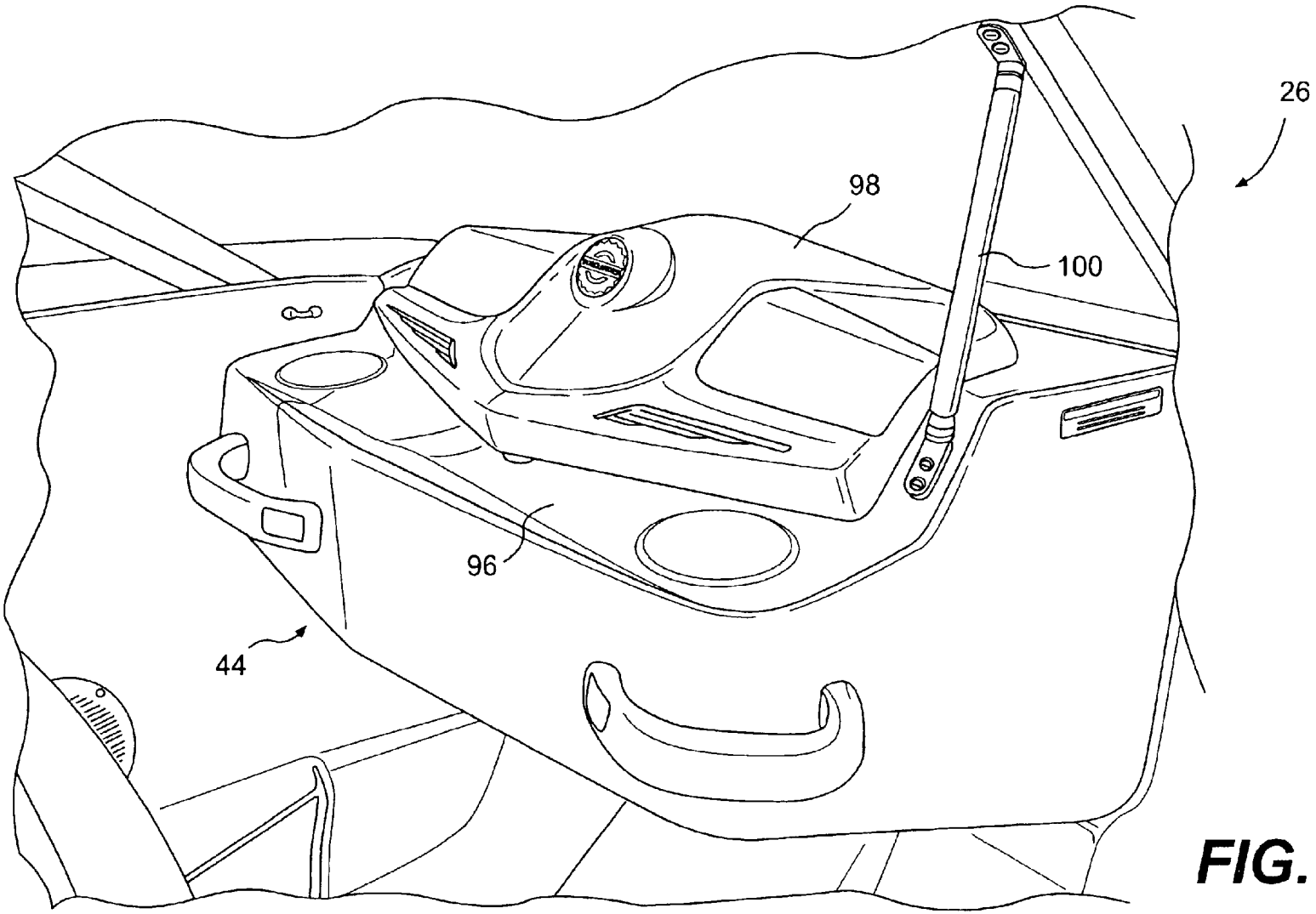
FIG. 14 is a perspective illustration of the port console (passenger's console) of the watercraft illustrated in FIG. 1, shown with the console cover in a closed position.
Figure 15:
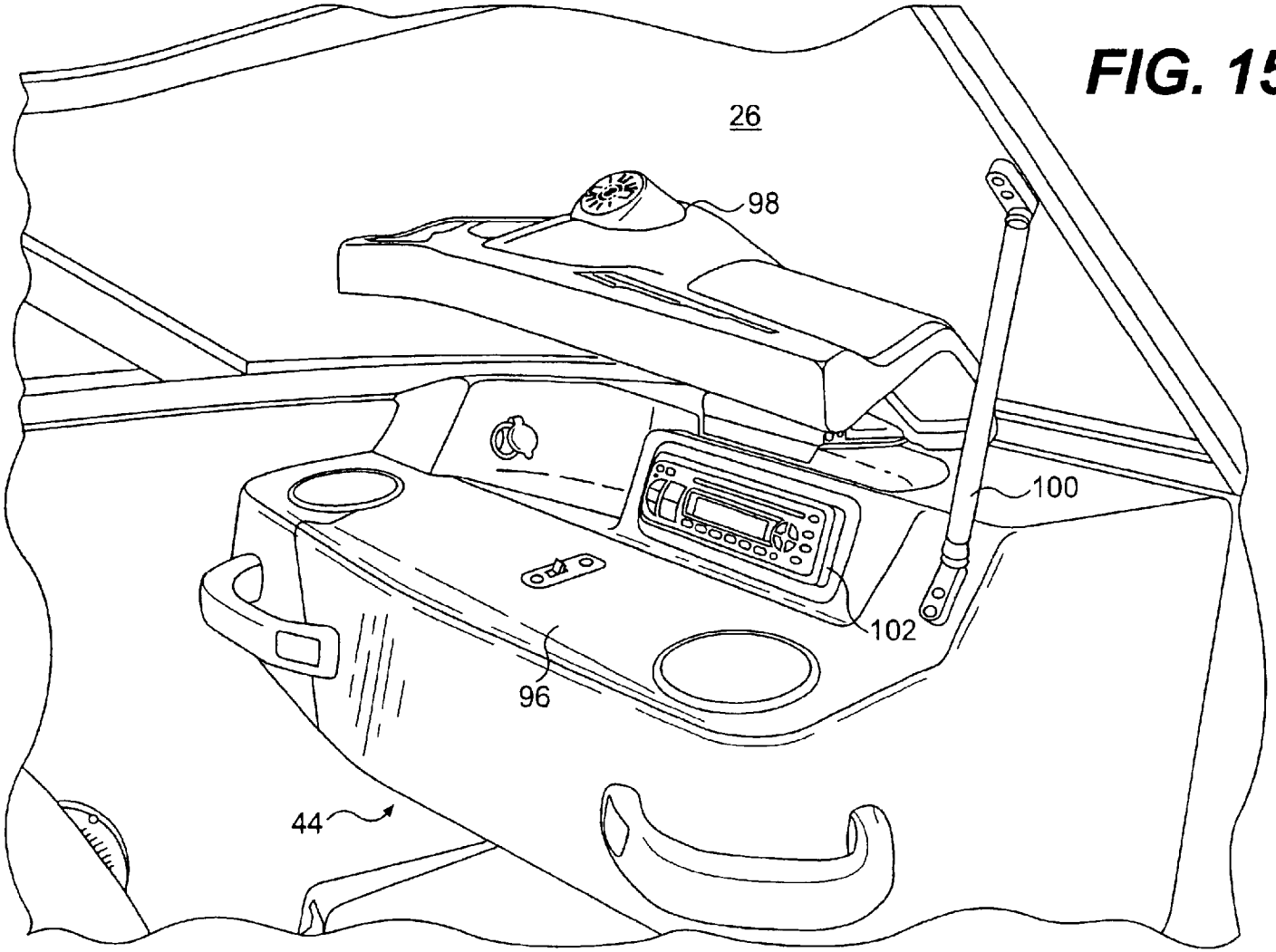
FIG. 15 is a perspective illustration of the port console of the watercraft shown in FIG. 14, shown with the console cover in an opened position.
Figure 16:
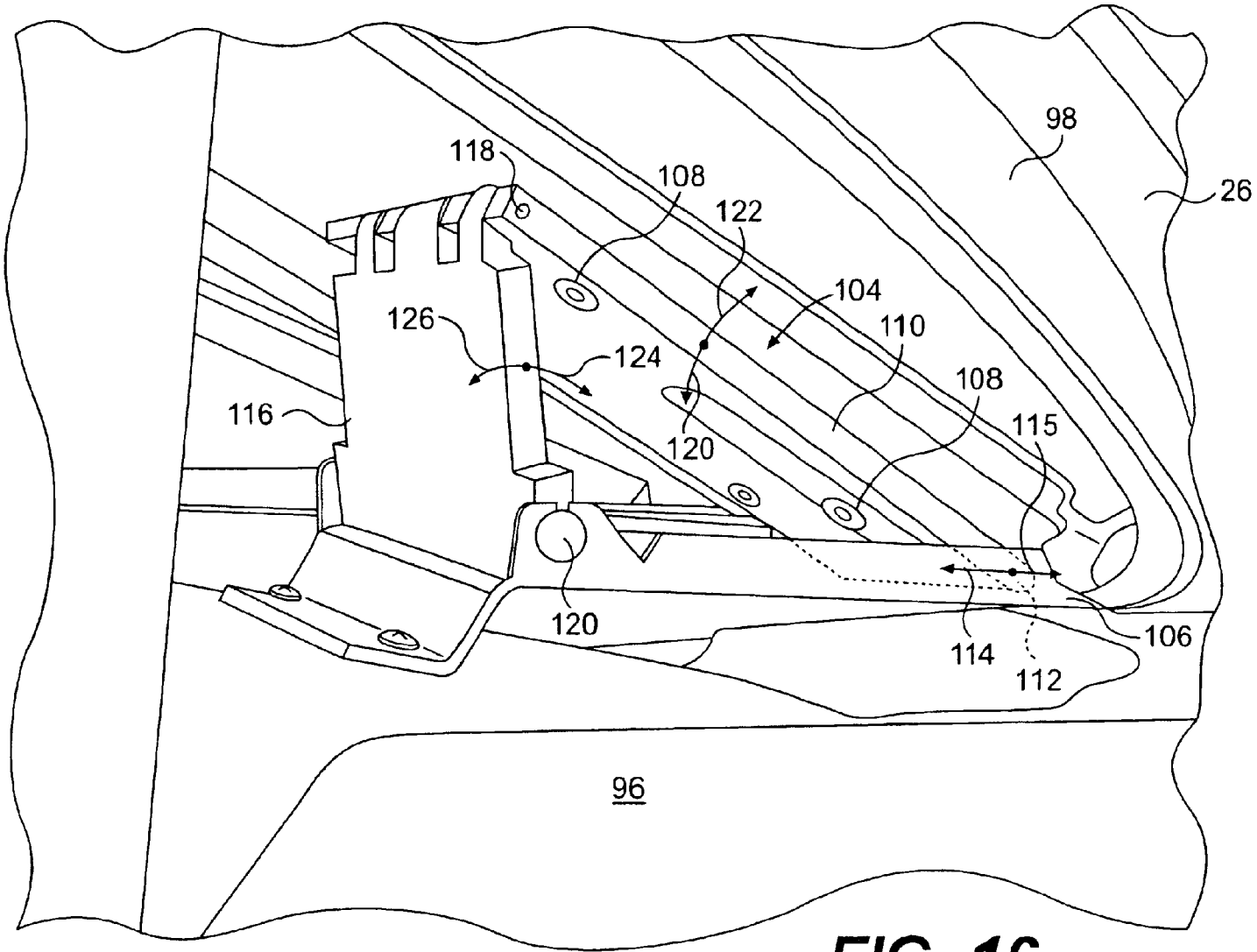
FIG. 16 is an enlarged, partial perspective illustration of the port console of the watercraft shown in FIG. 14, illustrating in detail the hinge beneath the console cover that permits the cover to opened beneath the windshield of the watercraft.

The port console 44 is illustrated in greater detail in FIGS. 14–16. The port console is positioned forward of the port buddy seat 38 behind the windshield 26. The port console 44 includes a base portion 96 and a top portion 98. The top portion 98 is hingedly articulated to the base portion 96 to permit the top portion 98 to be opened by riders on the watercraft 10. Also as illustrated in FIG. 14, a support brace 100 may extend from the console 44 to the windshield 26 to provide additional rigidity and support for the windshield 26.

FIG. 14 shows the top portion of the console 44 in the closed position. FIG. 15 illustrates the top portion 98 in the opened position, exposing a radio and CD player 102 that is disposed within the bottom portion 96 of the port console 44. The top portion (console cover) 98 may be provided with a lock so that the console cover 98 may be locked when the watercraft 10 is unattended, thus deterring theft of the radio and CD player 102 concealed thereunder.

FIG. 16 illustrates a hinge 104 that permits the top portion 98 of the port console 44 to be opened without interfering with the windshield 26. The hinge 104 is designed to permit the top portion 98 of the port console 44 to pivot upwardly while also permitting the rear portion of the console cover 98 to slide rearward toward the port buddy seat 38. It is preferred that the hinge 104 operates in this manner to prevent the top portion 98 of the port console from hitting the windshield 26 with a sufficient force when the console cover 98 is opened to break or damage the windshield 26.

As illustrated in FIG. 16, the hinge 104 includes a slide rail 106, which is affixed to the bottom portion 96 of the port console 44. The cover 98 is affixed, preferably by several fasteners 108, to a slide member 110. The slide member 110 is held in the slide rail 106 by a dowel 112 (or similar structure) that is disposed with a track (not shown) within the slide rail 106. As indicated, the dowel 112 permits the lower portion of the slide member 110 to slide in the directions shown by the arrows 114, 115. The slide member 110 is also pivotally connected to a support member 116 at a pivot point 118. The support member 118, in turn, is pivotally connected to the slide rail 106 through a pivot 120.

The hinge 104 operates in the following manner. When the console cover 98 is opened as illustrated in FIGS. 15 and 16, the dowel 112 slides in the direction indicated by the arrow 114. This prevents the cover 98 from striking the windshield 26. Once opened, the slide member 110 is disposed at an angle with respect to the support member 116. The console cover 98, therefore, is supported primarily by the support member 116. When a rider of the sport boat 10 desires to close the console cover 98, the rider applies pressure to the console cover 98 so that dowel 112 slides in the slide rail 106 toward the windshield 26 in the direction of the arrow 115. As the dowel 112 slides toward the windshield, the slide member 110 moves downwardly toward the slide rail 106 in the direction of the arrow 120 (the arrow 122 indicating the upward motion). Similarly, the support member 116 moves downwardly toward the slide rail 106 in the direction indicated by the arrow 124 (the arrow 126 indicating the upward motion). To open the console cover 98, a rider applies pressure to the forward edge of the console cover 98 and the hinge 104 opens in a direction opposite to the closing direction. Because the rear portion of the slide member 110 is permitted to slide within the slide rail 106, the console cover 98 is prevented from impacting (and potentially damaging) with the windshield 26.

The slide rail 106, slide member 110, and support member 116 are all preferably made from a corrosion-resistant material such as aluminum. However, as will be appreciated by those skilled in the art, the slide rail 106, slide member 110, and support member 116 may be made from a sufficiently rigid material, such as plastic, stainless steel, etc., if desired.

Figure 17:
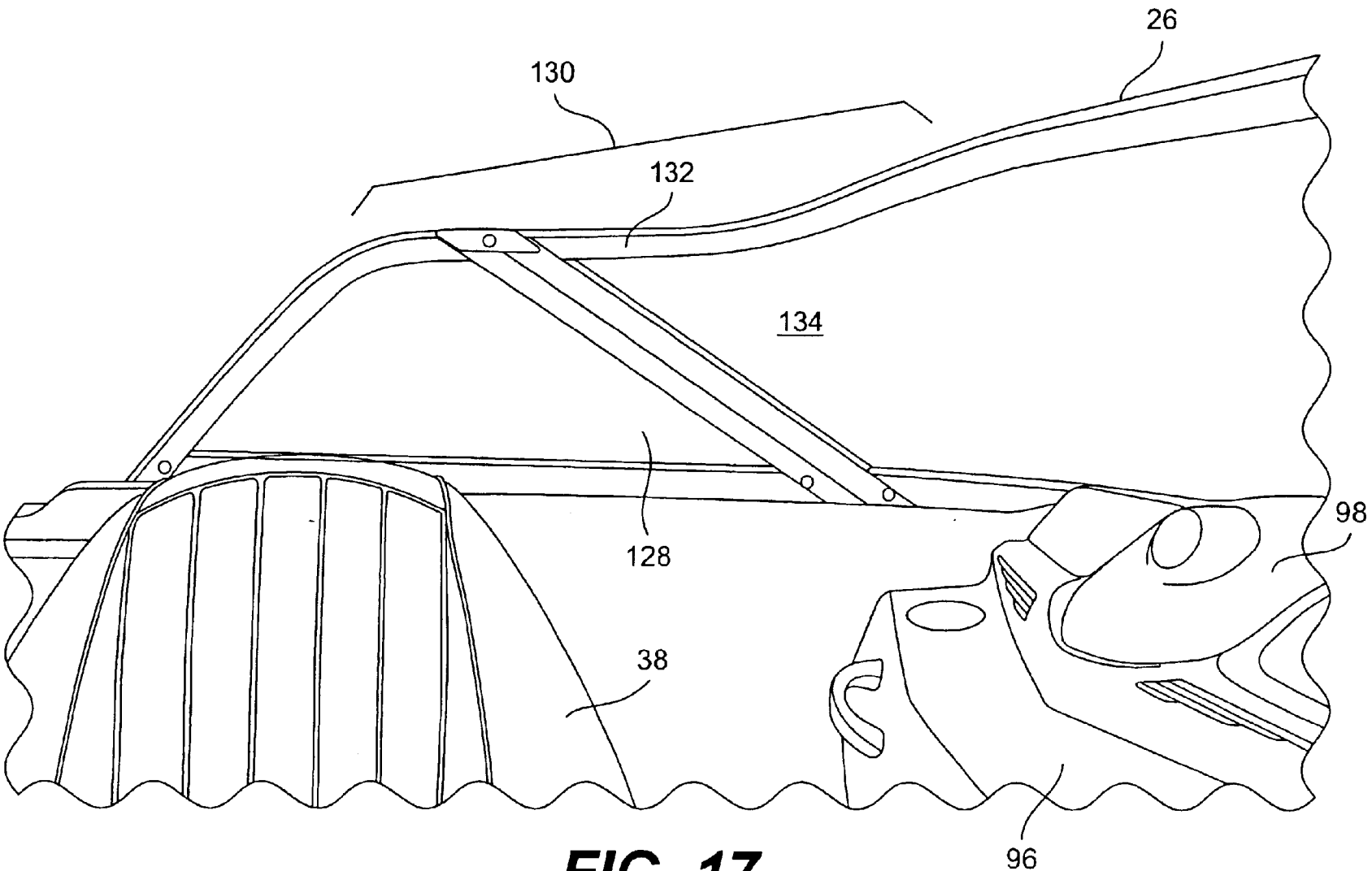
FIG. 17 is a partial perspective illustration of the watercraft shown in FIG. 1, the view facing the port of the watercraft from an interior vantage point, the view illustrating the curvature of the side portion of the windshield.

FIG. 17 illustrates a portion of the windshield 26, which wraps around a forward portion of the rearward passenger compartment 22. Windshield 26 extends at least partially adjacent to the port buddy seat 38 and the starboard buddy seat 40 to define side portions 128. The side portions 128 provide some protection from the wind for riders seated in either of the buddy seats 38, 40. The side portions 128 of the windshield 26 do not extend to the same height as windshields 26 in the prior art. Instead, the side portions 128 include a dip portion 130 that extends to a lower height than the front portion of the windshield 26. The dip portion 130 improves visibility of objects in the water for riders within the rearward passenger area 22, because objects in the water are not occluded by the frame 132 that surrounds the glass 134 in the windshield 26.

While it is preferred that the dip 130 in the side portions 128 of the windshield 26 be a smoothly-curved structure on the windshield 26, the dip 130 may be more angular without departing from the present invention. Preferably, the height of the dips 130 above the sides of the watercraft 10 are sufficiently low that a rider seated in either buddy seat 38, 40 may look over the frame 132 without having to stand up. The height, therefore, accommodates what designers refer to as a standard rider, which is a $50^{th}$ percentile North American Male. The standard rider is known to those skilled in the art and is used when designing vehicles to size various aspects of those vehicles. For example, the distance from the starboard buddy seat 40 to the steering wheel 48 is determined by the dimensions of the standard rider who is "placed" (at least mathematically) within the starboard buddy seat 40 during the design phase of the development of the watercraft 10.

Figure 18:
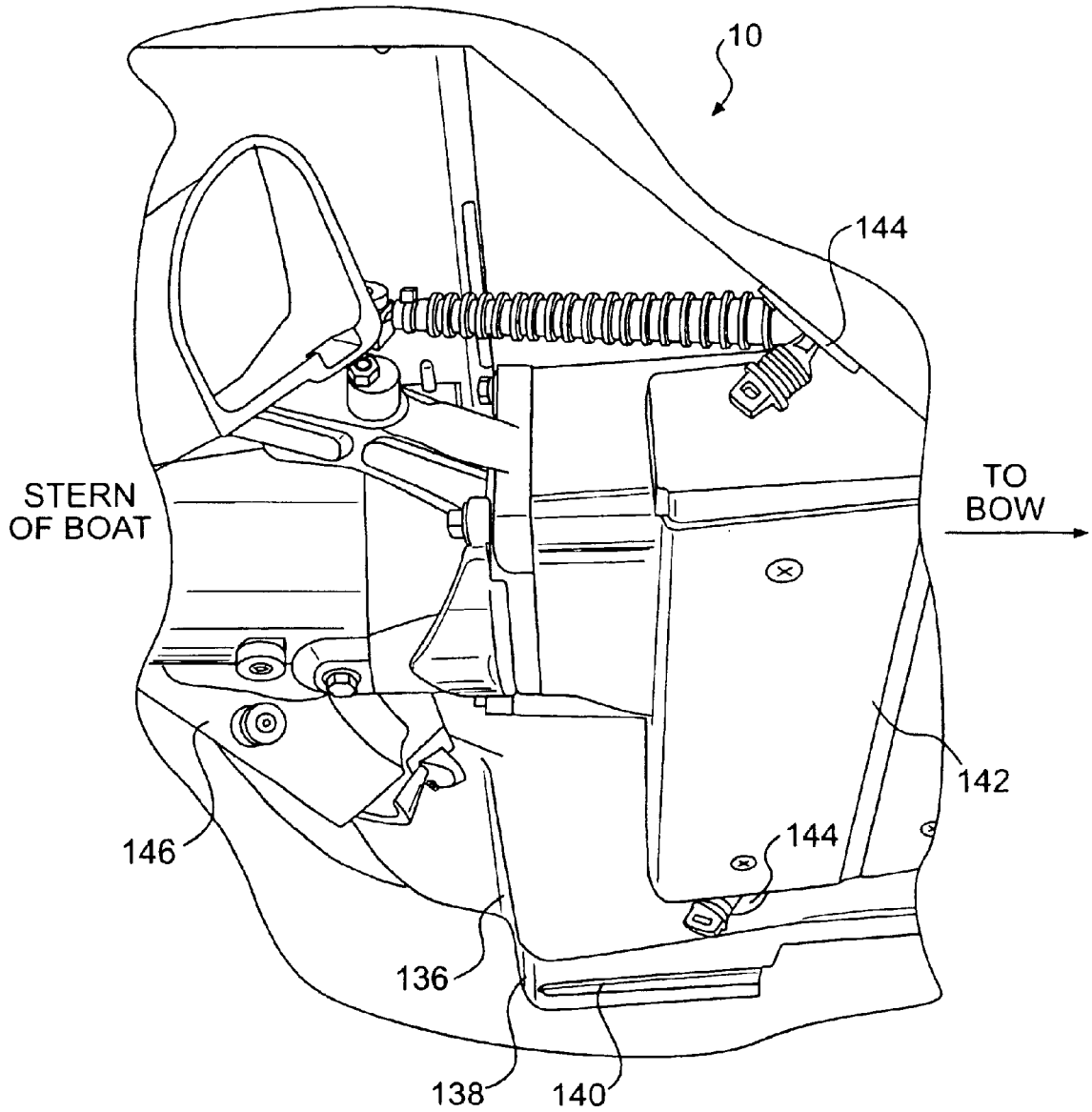
FIG. 18 is a partial perspective illustration of the underside of the stern of the watercraft as illustrated in FIG. 1, the view being of the rear most portion of the hull at the transition from the bottom of the hull to the transom at the rear of the watercraft.

FIG. 18 illustrates the rearward most portion of the sport boat 10. In particular, FIG. 18 illustrates the rear transom 136 of the watercraft 10 and the transition surface 138 to the bottom 140 of the hull 12. The rear transom 136 is the vertical surface at the stern 16 of the hull 12. FIG. 18 also shows a portion of the ride plate 142 disposed at the stern 16 of the sport boat 10. The stop cocks 144, which permit water to be drained from the interior of the hull 12 when the sport boat 10 has been removed from the water, also can be seen in FIG. 18. In addition, a portion of the directional nozzle 146, which directs the flow of water from the jet propulsion system to steer the watercraft 10, is shown.

Figure 19:
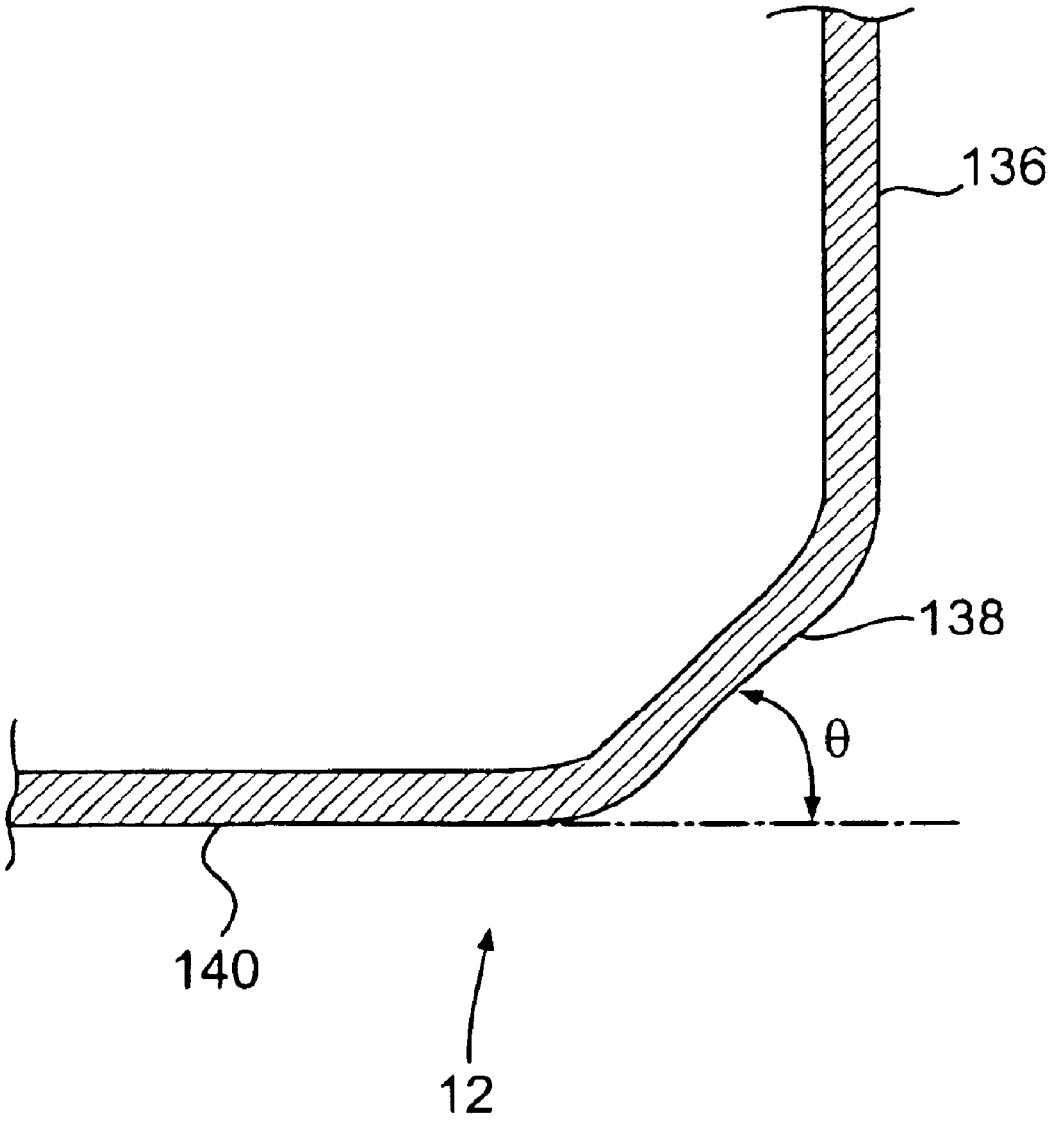
FIG. 19 is a partial cross-sectional view of the hull of the watercraft illustrated in FIG. 1, the cross-section being taken at the transition point between the bottom surface and the rear transom of the hull.

As illustrated in FIG. 19, the transition surface 138 is disposed at an angle θ to the bottom 140 of the hull 12. In the prior art, the angle of transition was either 90 degrees or was a slowly curving surface (i.e., a surface with a large radius of curvature). One problem encountered in boats that incorporated a surface with a large radius of curvature at the transition between the bottom 140 of the boat and the rear transom 136 was that the curved surface created a significant amount of drag on the hull 12. The drag was large enough to adversely affect operation of the boat, at least under certain circumstances.

In the present invention, the transition surface 138 is disposed at an angle θ to the bottom 140 of the hull 12. The flat transition surface 138 does not create drag on the hull 12 as did the prior art transition surface with a large radius of curvature. In the preferred embodiment, the angle θ is about 45 degrees. However, as would be appreciated by those skilled in the art, the angle could be within any range suitable to prevent, or at least minimize drag on the hull 12.

Ideally, to avoid drag on the hull 12, a surface with a small radius of curvature should be positioned in the same location as the transition surface 138. However, current manufacturing techniques do not readily permit such a construction. Accordingly, to obtain a radius of curvature from the bottom 140 of the boat 10 to the rear transom 136 that is sufficient to minimize drag on the hull 12, a 45 degree angle for the transition surface 138 is employed. A small radius of curvature is preferred, because it is believed that a small radius of curvature permits the water to break away from the stern of the hull 12 more easily, thereby minimizing drag on the hull 12. A large radius of curvature, on the other hand, allows the water to follow the contours of the hull 12, thereby increasing drag on the hull 12.

Figure 20:
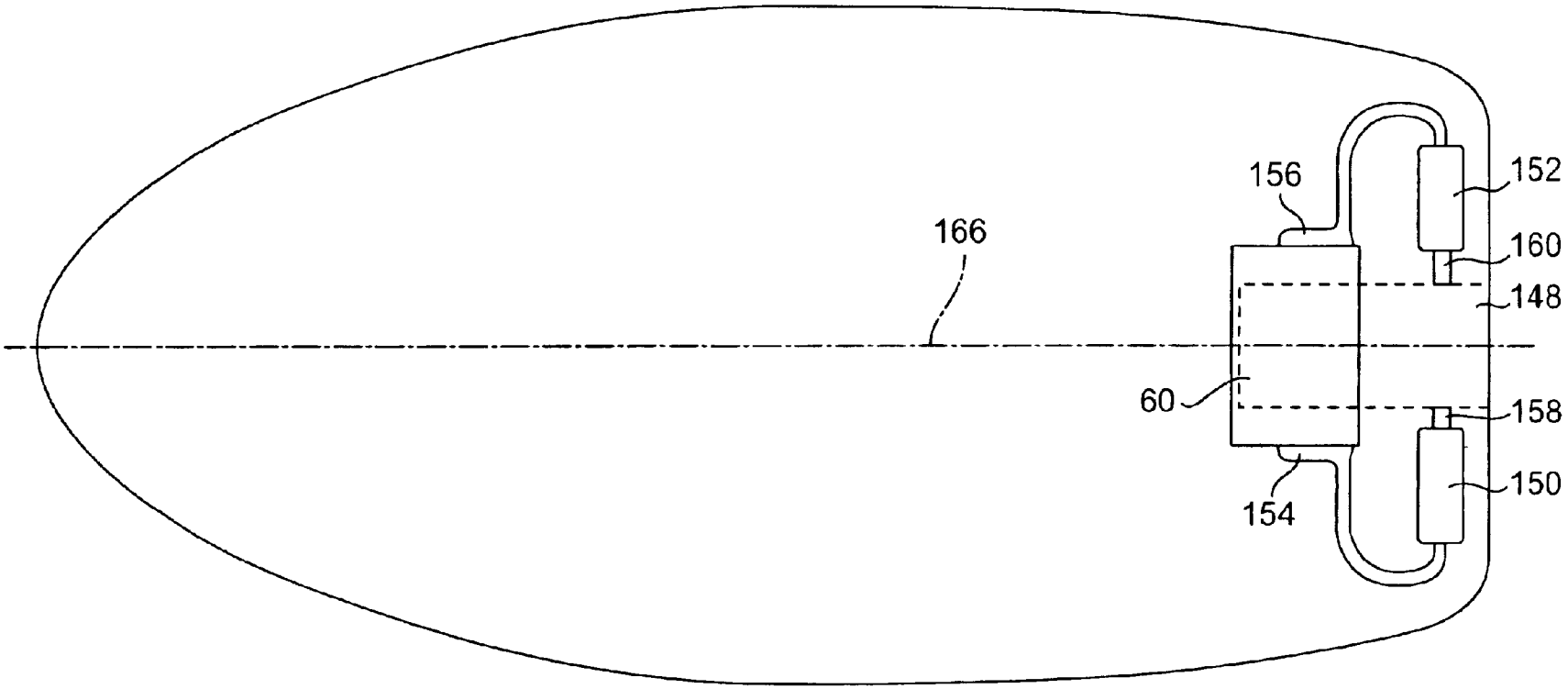
FIG. 20 is a top schematic view of a first embodiment of the engine and resonator canister arrangement for the watercraft illustrated in FIG. 1.
Figure 21:
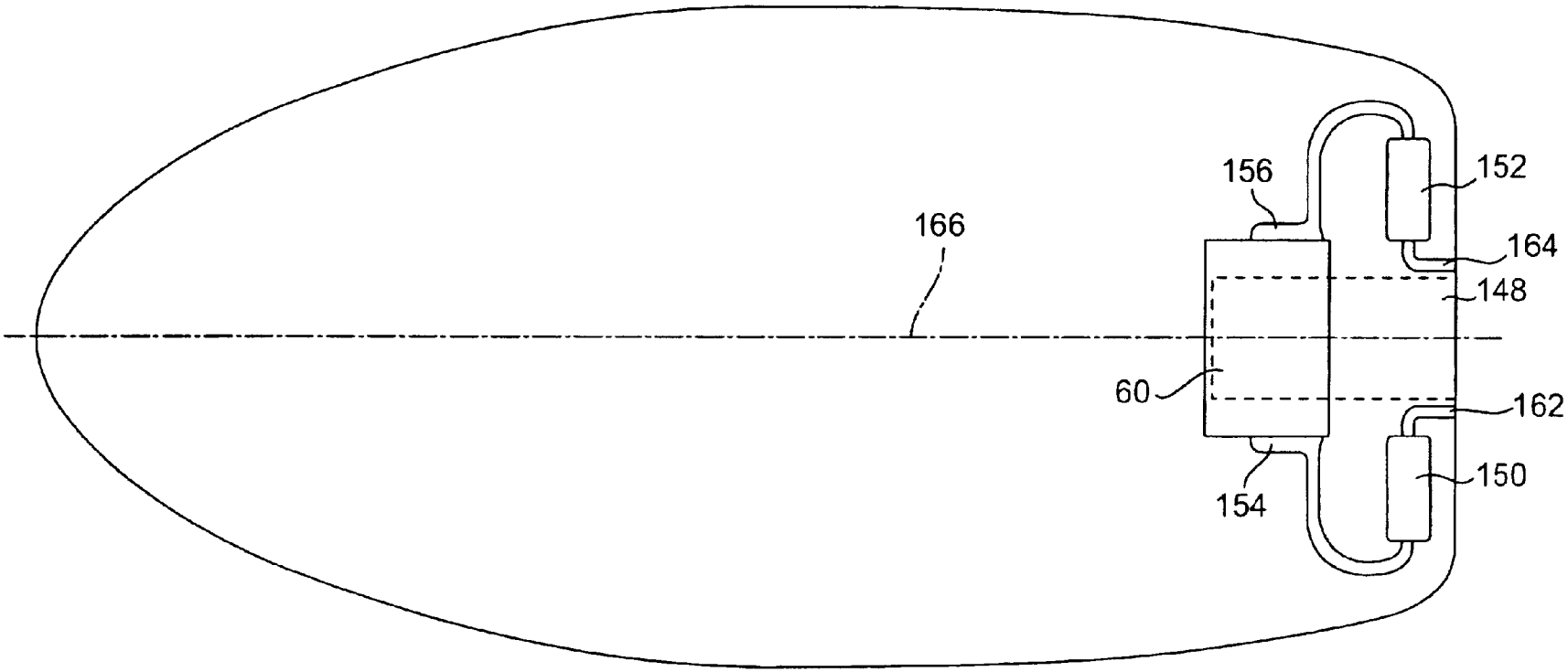
FIG. 21 is a top schematic view of a second embodiment of the engine and resonator canister arrangement for the watercraft illustrated in FIG. 1.

FIGS. 20 and 21 provide simple schematic views of the engine and resonator canister arrangements for the sport boat 10 of the present invention. Resonator canisters are also commonly referred to as mufflers, although the term "resonator canister" is considered to be broader than the term "muffler." For purposes of the present invention, the terms "muffler" and "resonator canister" are meant to be interpreted as broadly as possible.

In both of the embodiments illustrated in FIGS. 20 and 21, the engine 60, which sits over the water passage 148, is connected to a port resonator canister 150 and a starboard resonator canister 152 through a port manifold 154 and a starboard manifold 156, respectively. The water passage 148 extends from an inlet at the bottom of the hull 12 (at a position forward of the stern 16) to an outlet at the rear of the watercraft 10. Water is drawn into the inlet by the impeller within the water passage 148 and discharged through the outlet at great pressure to propel the watercraft 10.

While FIGS. 20 and 21 illustrate port and starboard manifolds 154, 156 connected to the resonator canisters 150, 152, those skilled in the art would recognize that this is not the only configuration possible or desired. To the contrary, the engine 60 may be provided with a single manifold to which both resonator canisters 150, 152 are connected. Alternatively, the resonator canisters need not be connected to the engine 60 in parallel, but could be connected to the engine 60 in series, as desired.

In the embodiment illustrated in FIG. 20, the port and starboard resonator canisters 150, 152 direct exhaust gases from the engine 60 into the water tunnel 148 through port and starboard exhaust pipes 158, 160. In the embodiment illustrated in FIG. 21, the resonator canisters 150, 152 direct the exhaust gases from the engine 60 toward the rear of the watercraft 10 through port and starboard exhaust pipes 162, 164. Being directed into the water passage 148, the exhaust pipes 158, 160 empty the exhaust from the engine 60 directly into the water. The exhaust pipes 162, 164 similarly may be positioned so that the exhaust from the engine 60 is directed in to the water. However, the exhaust pipes 162, 164 may discharge the exhaust directly into the atmosphere, if desired.

Regardless which path the exhaust takes from the engine 60 to the environment, the position of the resonator canisters 150, 152 is one aspect of the present invention. In particular, the resonator canisters 150, 152 are positioned rearwardly of the engine 60 and are oriented so that their longitudinal axes are not substantially parallel to the centerline 166 of the watercraft 10 as in the prior art. Preferably, the resonator canisters 150, 152 are oriented so that their longitudinal axes are substantially perpendicular to the centerline 166 of the watercraft 10. So positioned within the hull 12, the resonator canisters 150, 152 provide considerable additional room for storage within the watercraft 10, because the resonator canisters 150, 152 do not occupy valuable space adjacent to the engine 60, which is where they are normally positioned.

In addition, the resonator canisters 150, 152 are angled so that their discharge ends are lower than their inlet ends. This permits any water that may have entered the resonator canisters 150, 152 to drain from the resonator canisters 150, 152 both during and after operation of the engine 60.

Figure 22:
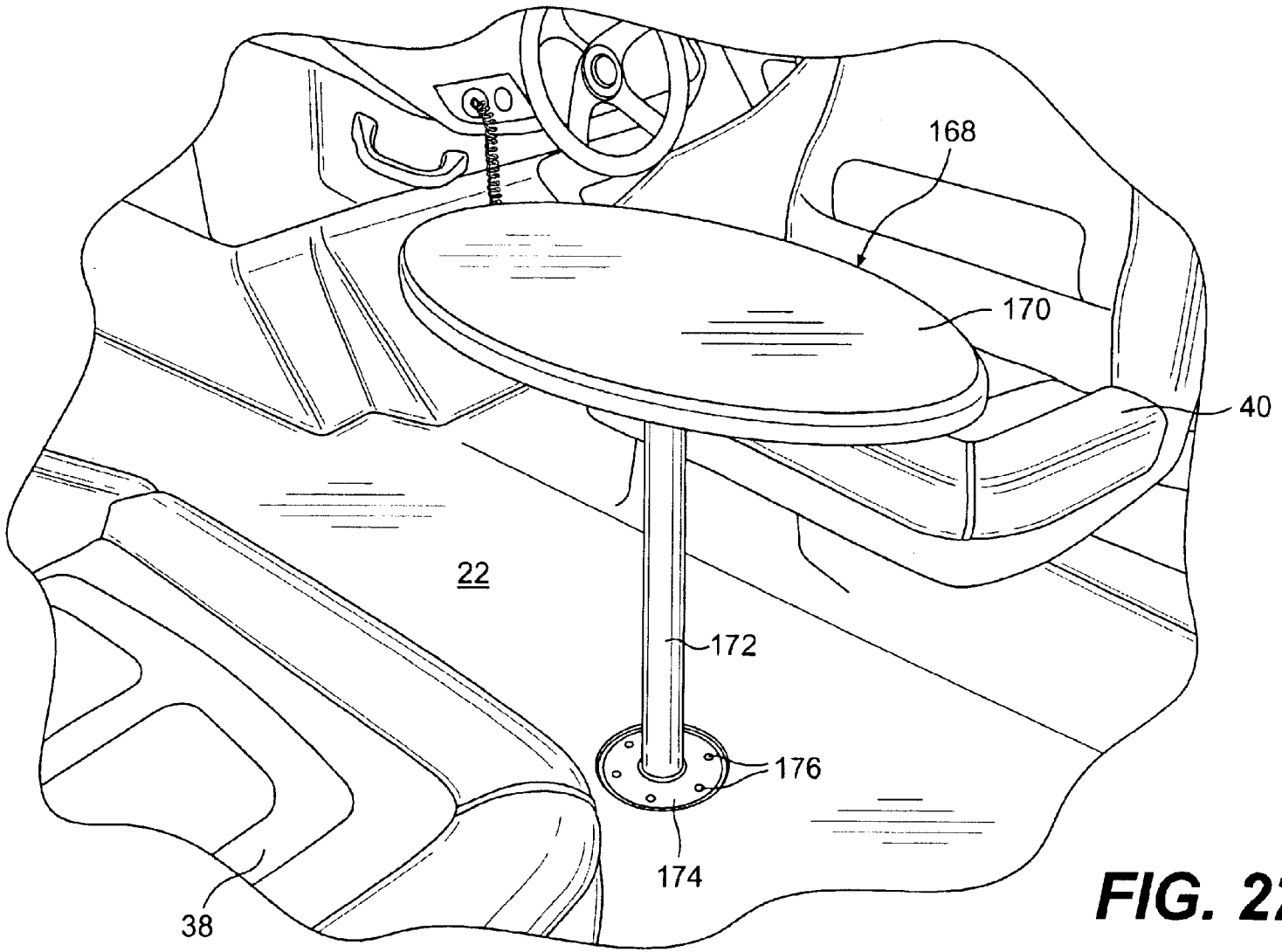
FIG. 22 is a perspective view a table positioned within the passenger area.

FIG. 22 illustrates one additional aspect of the present invention, a stowable table 168. The stowable table 168 includes a table top 170, which is oval in the embodiment illustrated. The table top 170 sits atop a table leg 172, which has been inserted into a support bracket 174 mounted on the deck in the rearward passenger area 22 between the two buddy seats 38, 40.

In the embodiment illustrated, the table top 170 and the table leg 172 preferably are made of a light weight material such as plastic. Alternatively, the table top and leg may be made of any suitable material, so long as the material resists degradation when exposed to environmental conditions such as sun, rain, and sea water. The bracket 174 preferably is made of a metal material, such as steel, and is attached to the floor of the rear passenger area 22 with one of more bolts 176. Preferably, the bracket 174 is semi-permanently attached to the floor of the rearward passenger area 22 and is flush with the floor so that passengers within the watercraft 10 do not trip over the bracket 174. Being semi-permanently attached to the floor, the bracket 174 may be removed from the floor of the rearward passenger area 22. However, it is contemplated that the bracket 174 will remain attached to the floor during the operational lifetime of the watercraft 10.

Figure 23:
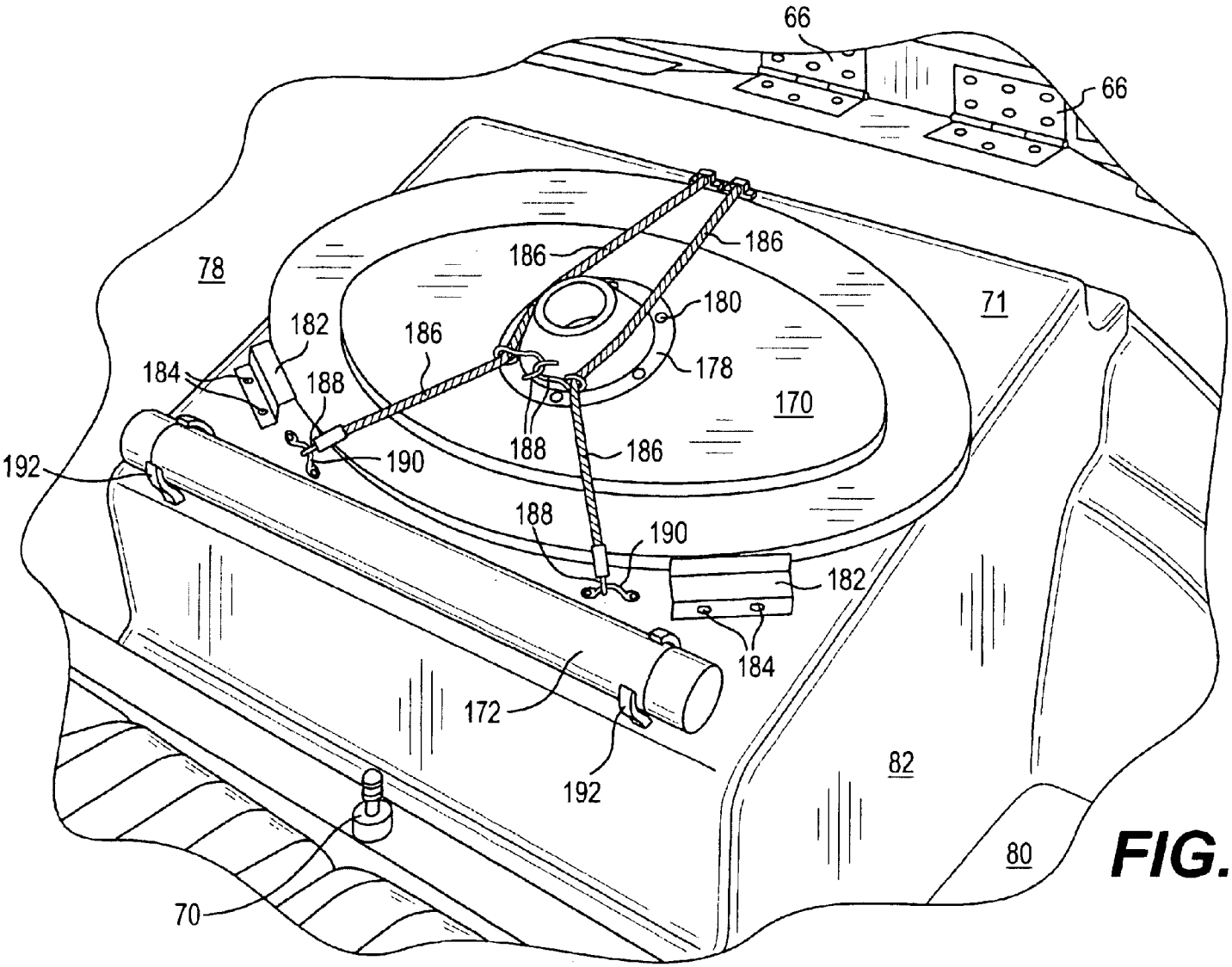
FIG. 23 is a perspective view of the table, in a disassembled state, stored over the secondary engine cover.

The table leg 172 preferably is a cylindrical element where the bottom end fits within a central hole (not shown)

in the bracket 174, the top end of the leg 170 fits within a bracket 178 affixed to the bottom of the table top 170, which is illustrated in FIG. 23. Therefore, when the watercraft 10 is not in motion and the buddy seats 38, 40 are rotated to their relaxed positions, as shown in FIG. 22, the table leg 172 may be inserted into the bracket 174 and the table top 170 may be installed atop the table leg 172 via the bracket 178. As would be appreciated by those skilled in the art, while the table leg 172 is shown as a cylindrical element, the table leg 172 may be any suitable shape, such as square, rectangular, ovoid, elliptical, or the like, without departing from the scope of the present invention.

For stability and strength, the bracket 178 preferably is made of a metal, such as steel or aluminum. As would be appreciated by those skilled in the art, however, the bracket 178 may be made of any suitable alternative material such as plastic. The bracket 178 preferably is affixed to the table top 170 via one or more fasteners 180, such as screws. Alternatively, the bracket 178 may be affixed to the bottom of the table top 170 via any other suitable fastener, including an adhesive.

For stowage, the table 168 may be disassembled. As illustrated in FIG. 23, the table 168 may be stored on the secondary engine cover 71 above the engine 60 at the stern of the watercraft 10. So that the table top 170 is securely fastened to the secondary engine cover 71, two brackets 182 are attached to the secondary engine cover 71 via suitable fasteners 184, such as the nut and bolt combination shown. Alternatively, the brackets 182 may be affixed to the secondary engine cover 71 by an adhesive. The brackets 182 preferably are made of a plastic material, although a metal, such as steel or aluminum, may be substituted therefor without deviating from the scope of the present invention.

To secure the table top 170 against the secondary engine cover 71, elastic straps 186 with hooks 188 may be provided. The hooks 188 may interconnect with one another and also be removably connected to brackets 190 so that the table top 170 is properly secured atop the secondary engine cover 71. As would be appreciated by those skilled in the art, the elastic straps 186 may be substituted with any other type of securement device, such as one or more clamps, without deviating from the scope of the present invention.

The table leg 172 also may be secured to the secondary engine cover 71, as illustrated in FIG. 23. To secure the table leg 172, a pair of flexible brackets 192 are affixed to the secondary engine cover 71 adjacent to the brackets 182. The table leg 172 snap-fits within the brackets 192 to secure the table leg 172 to the secondary engine cover 71. As would be appreciated by those skilled in the art, any other suitable fastening device may be substituted therefor without deviating from the scope of the present invention.

Figure 24:
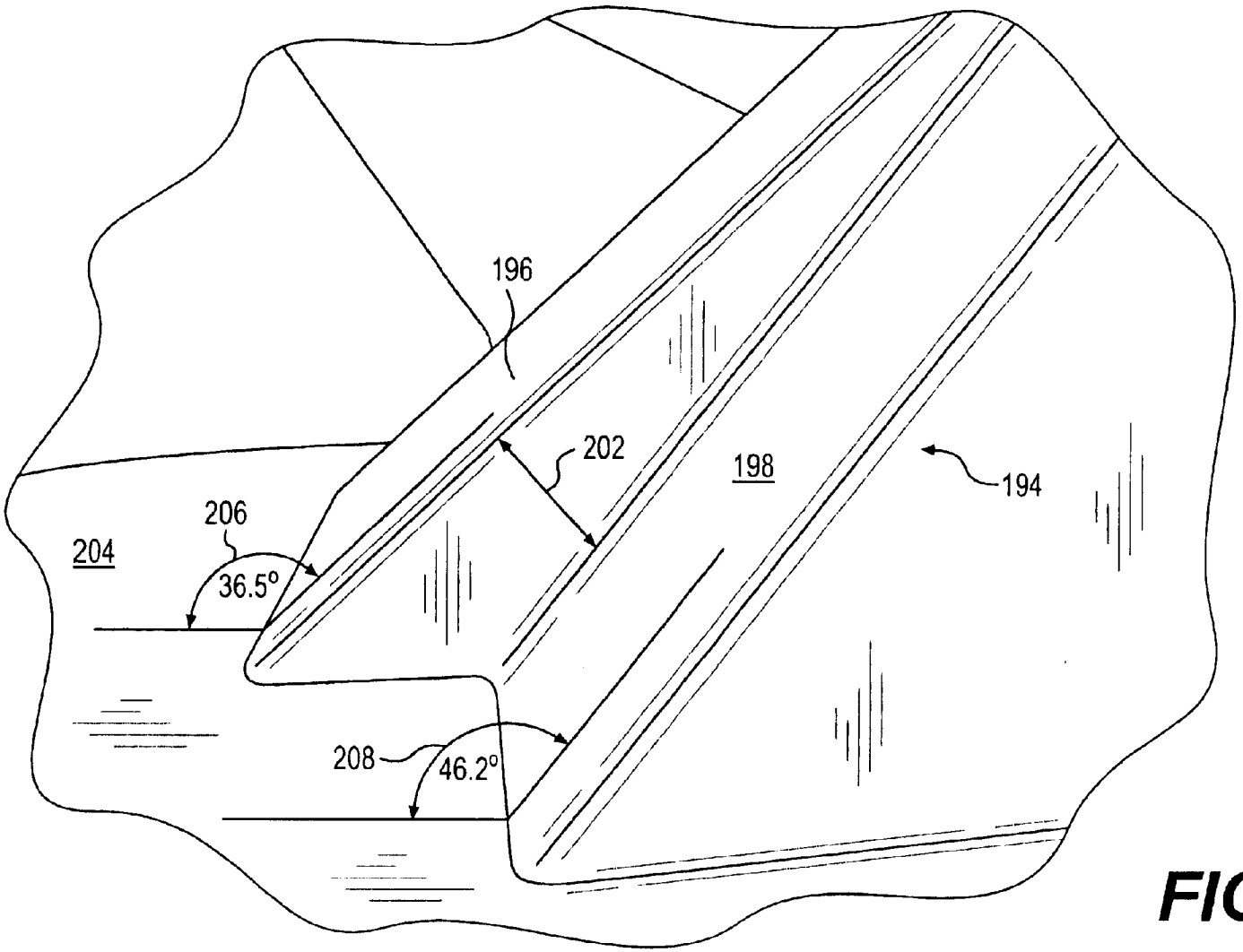
FIG. 24 is a side view of a foot rest portion for the watercraft illustrated in FIG. 1.
Figure 25:
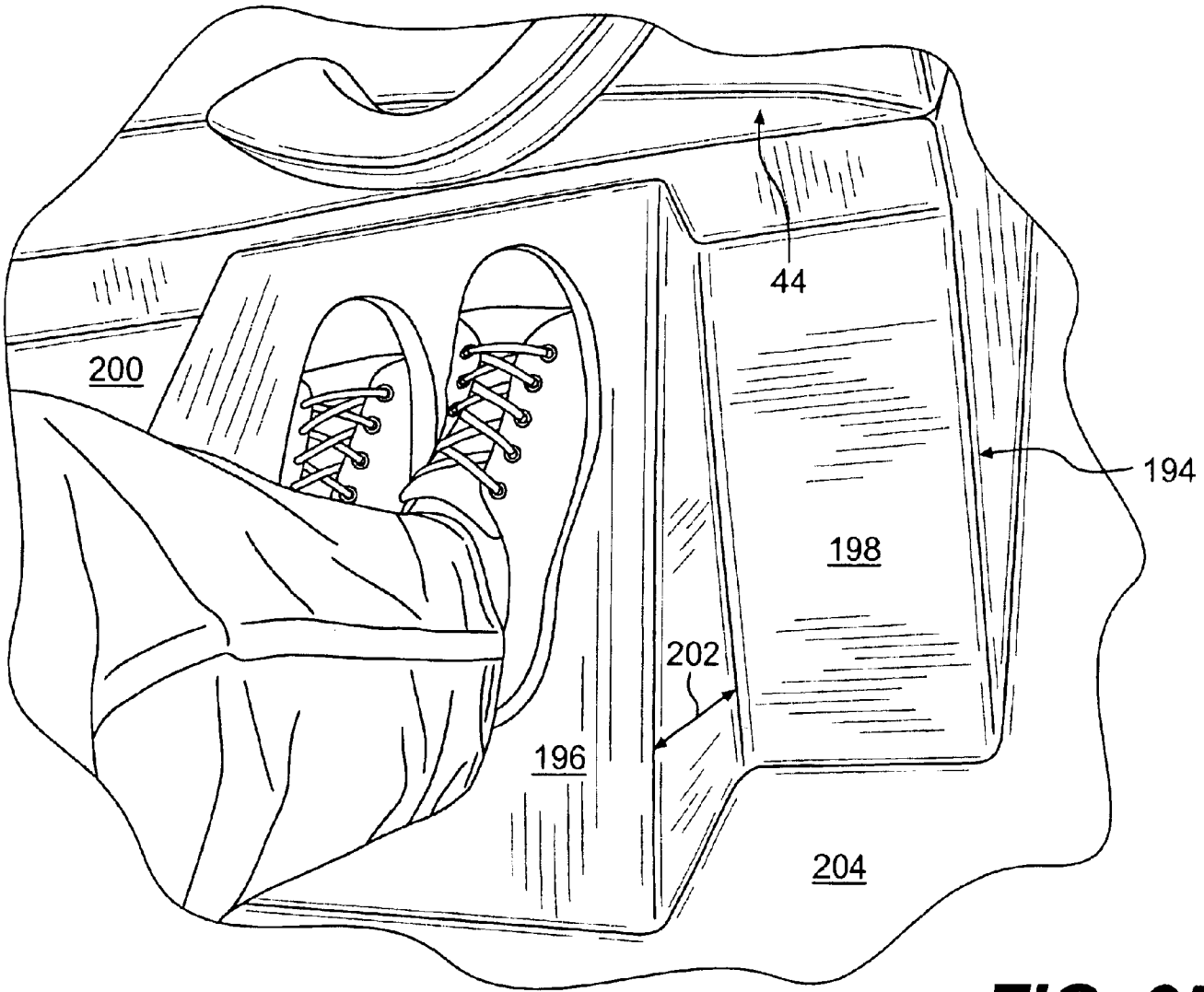
FIG. 25 is a perspective view of the foot rest portion shown in FIG. 22, showing the passenger's feet in a first position.
Figure 26:
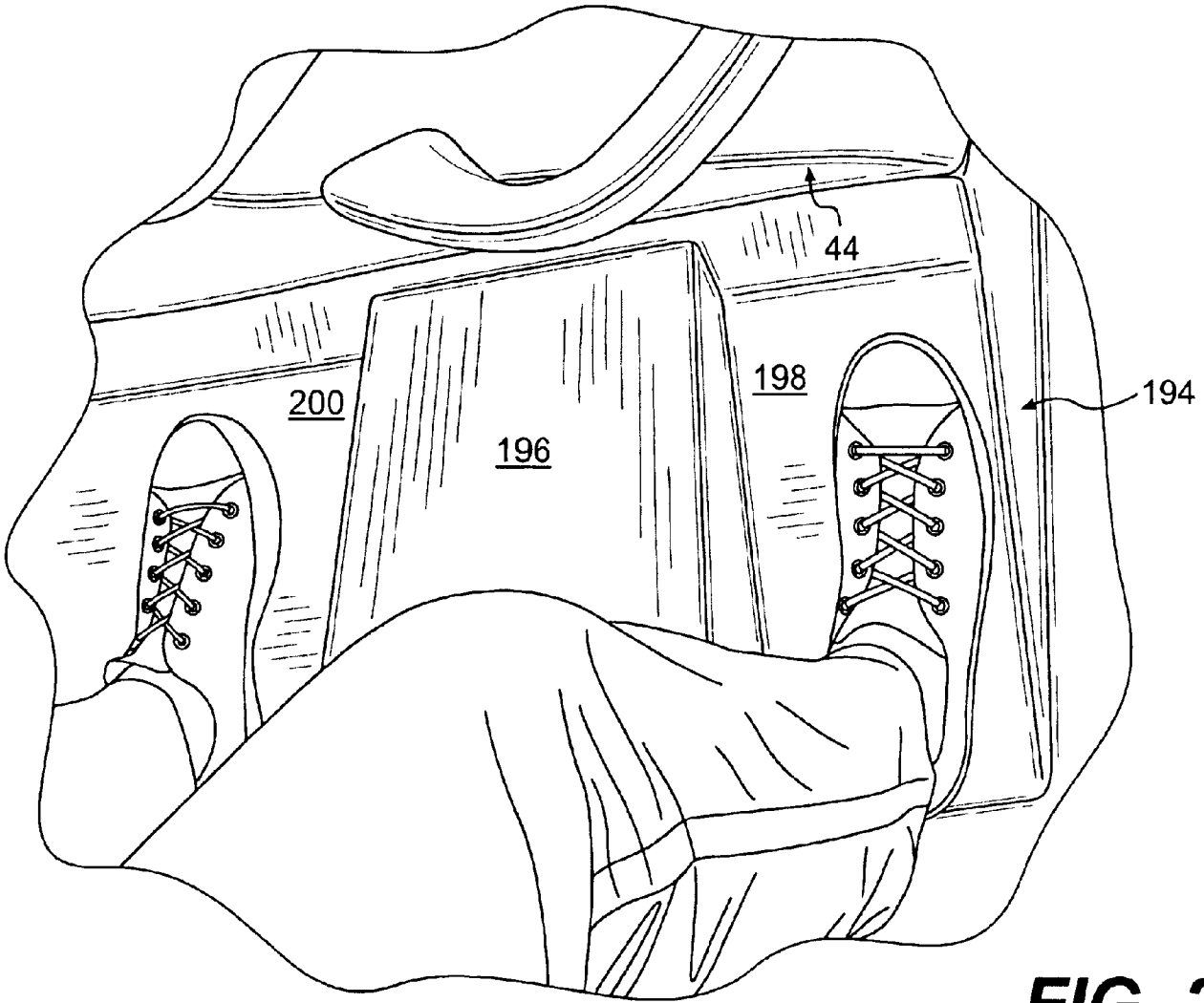
FIG. 26 is a perspective view of the foot rest portion shown in FIG. 22, showing the passenger's feet in a second position.

FIGS. 24–26 illustrate one further aspect of the watercraft 10 of the present invention. In particular, these three figures illustrate the details of a foot rest portion 194 beneath one or both of the port and starboard consoles 44, 46.

As detailed in FIGS. 24–26, the foot rest portion 194 comprises a central foot rest incline 196 flanked on either side by lateral foot rest inclines 198, 200. The central foot rest incline 196 is positioned a predetermined distance 202 above the positions of the lateral foot rest inclines 198, 200. In the embodiment illustrated, the lateral foot rest inclines 198, 200 are at the same predetermined distance 202 from the central foot rest incline 196. As would be appreciated by those skilled in the art, the lateral foot rest inclines 198, 200 need not be disposed from the central foot rest incline 196 the same distance 202. To the contrary, the lateral foot rest incline 196 may be disposed closed to the central foot rest incline 196 than the lateral foot rest area 200. Alternatively, the lateral foot rest incline 200 may be disposed closer to the central foot rest incline 196 than the other lateral foot rest incline 198.

As illustrated, the three foot rest inclines 196, 198, 200 are preferably integrally molded as a part of the deck 18. As would be appreciated by those skilled in the art, however, the three foot rest inclines 196, 198, 200 may be separately molded and attached to the deck 18 by any suitable fastener, such as a nut and bolt combination or an adhesive, among others.

FIG. 24 provides additional details concerning the positioning of the foot rest inclines 196, 198, 200 with respect to the floor 204 of the deck 18. In particular, central foot rest incline 196 preferably is disposed at an angle 206 to the floor 204 of between about 30 to 40 degrees. More specifically, the central foot rest incline 196 is angled from the floor 204 at the angle 206 between 32 to 38 degrees. The range of the angle 206 is more specifically between 35 and 37 degrees. Most specifically, the angle 206 is about 36.5 degrees. Similarly, the lateral foot rest inclines 198, 200 are disposed at an angle 208 with respect to the floor 204 that is between 40 an 50 degrees. More specifically, the range of the angle 208 is between 42 and 48 degrees. Even more specifically, the angular range is between 45 and 47 degrees. Most specifically, the angle is about 46.2 degrees.

The three foot rest inclines 196, 198, 200 provide the passenger with varied foot positions, which greatly enhances the comfort level provided by the watercraft 10. In particular, the three foot rest inclines 196, 198, 200 provide two primary foot positions. The first is illustrated in FIG. 25, where both of the passenger's feet are positioned on the central foot rest incline 196. FIG. 26 illustrates the second foot rest position where the passenger's feet are positioned one on each of the lateral foot rest inclines 198, 200. These two foot rest positions not only provide alternative foot rest positions for increased comfort, they are also designed to accommodate passengers of differing heights. A tall passenger likely will find the lateral foot rest inclines 198, 200 to be more comfortable than the central foot rest incline 196. On the other hand, a shorter passenger likely will find that the central foot rest incline 196 offers a more comfortable position than the two lateral foot rest areas 198, 200.

As illustrated, the central foot rest incline 196 preferably is positioned roughly at a central location beneath either or both of the port and starboard consoles 44, 46. However, as would be appreciated by those skilled in the art, the central foot rest incline 196 may be disposed to the port or starboard side of the center of the console 44, 46 without departing from the scope of the present invention.

In addition, while the foot rest incline 196, 198, 200 are illustrated in close proximity to the port and starboard consoles 44, 46, the inclines 196, 198, 200 may be positioned at any location on the deck 18 without deviating from the scope of the present invention.

The present invention is not meant to be limited solely to the embodiments described herein. To the contrary, the present invention is intended to be much broader, as evidenced by the claims appended hereto.

What is claimed is:

1. A watercraft comprising:

a powered hull defining lateral and longitudinal directions;

a deck disposed on the hull;

a passenger seat disposed laterally on the deck, the passenger seat having a least one seat section, the at least one seat section being removable to expose an opening into the hull, the opening having a first width defined by first and second lateral edges;

a storage compartment in the hull beneath the opening, the storage compartment extending laterally across substantially the width of the deck between a first and second lateral ends, the storage compartment having a second width, wherein the first width is smaller than the second width; and a driver's seat, wherein the storage compartment is disposed rearwardly of the driver's seat.

2. The watercraft of claim 1, wherein at least the first lateral end of the storage compartment is substantially coextensive with the first lateral edge of the opening.

3. The watercraft of claim 2, wherein the second lateral end of the storage compartment is disposed a lateral distance beyond that of the second lateral edge of the opening.

4. The watercraft of claim 1, wherein the storage compartment has a substantially larger length in the lateral direction than in the longitudinal direction.

5. The watercraft of claim 4, wherein the at least one seat section comprises a bench seat positioned toward a stern within a passenger area.

6. The watercraft of claim 2, wherein the lateral length of the storage compartment is at least ¾ of the beam of the boat.

7. The watercraft of claim 2, wherein the storage compartment's longitudinal length is less than ½ of the storage compartment's lateral length.

8. A watercraft comprising:

a hull having a transom;

an engine mounted in the hull forward of the transom;

at least one storage compartment positioned laterally adjacent to the engine;

a removable wall portion disposed between the engine and the storage compartment, wherein removal of the wall portion facilitates access to at least a portion of the engine adjacent to the storage compartment; and an engine cover, the engine cover being selectively movable between opened and closed positions, wherein the engine cover covers the engine when in the closed position and allows access to the engine when in the opened position.

9. The watercraft of claim 8, wherein the at least one storage compartment comprises two storage compartment, one disposed laterally on each side of the engine.

10. The watercraft of claim 8, further comprising:

an engine cover, the engine cover being selectively movable between opened and closed positions, wherein the engine cover encloses the storage compartment when in the closed position and allows access to the storage compartment when in the opened position.

11. The watercraft of claim 10, further comprising:

a secondary engine cover, the secondary engine cover being selectively movable between opened and closed, wherein the secondary engine cover covers the engine when in the closed position and allows access to the engine when in the opened position.

12. The watercraft of claim 8, wherein the wall portion comprises at least one of a sound and a heat shield.

13. A watercraft comprising:

a hull defining a longitudinal axis;

a deck disposed on the hull;

a transversely extending transom at the rear of the hull;

an engine disposed within the hull, the engine having an exhaust port; and at least one resonator canister in fluid communication with the exhaust port of the engine and disposed forward of the transom, wherein the resonator canister exhausts to an external side of the hull, wherein the resonator canister is mounted within the hull such that the resonator canister is not parallel with the longitudinal axis of the hull, and wherein the resonator canister is angled downwardly at one end so that the resonator canister is self-draining.

14. The watercraft of claim 13, wherein the resonator canister is mounted transversely to the longitudinal axis of the hull.

15. The watercraft of claim 13, wherein:

the watercraft defines a waterline when operating, the watercraft comprises an exit port in fluid communication with the resonator canister, and the exit port is positioned below the waterline.

16. The watercraft or claim 13, wherein:

the watercraft defines a waterline when operating, the watercraft comprises an exit port in fluid communication with the resonator canister, and the exit port is positioned above the waterline.

17. The watercraft of claim 13, wherein:

the watercraft comprises an exit port in fluid communication with the resonator canister, the exit port is disposed below the resonator canister, and the resonator canister is angled downwardly toward the exit port.

18. The watercraft of claim 13, further comprising:

a jet propulsion system operatively connected to the engine, the jet propulsion system having a water passage, and an exit port in fluid communication with the water passage, wherein the exit port is operatively connected to the water passage such that the engine exhausts through the resonator canister into the water passage.

19. The watercraft of claim 13, wherein the at least one resonator canister comprises a starboard resonator canister disposed in a starboard side of the hull and a port resonator canister disposed in a port side of the hull.

20. A watercraft comprising:

a powered hull having side gunwales;

a passenger area disposed within the hull;

a control console disposed within the passenger area;

a seat disposed within the hull behind the control console; and a windshield with a front and port and starboard lateral sides mounted on the hull, the port and starboard lateral sides extending rearwardly from the front, wherein the front of the windshield extends upwardly from the hull in front of the seat to a predetermined height, wherein the port and starboard sides extend upwardly from the gunwales and connect to the front of the windshield at forward portions thereof, and wherein at least one of the port and starboard sides includes a dip at a top portion thereof, lowering a height thereof to less than the predetermined height of the front of the windshield.

21. The watercraft of claim 20, wherein the dip facilitates lateral visibility from the seat behind the control console over the side of the windshield including the dip.

22. The watercraft of claim 20, wherein both the port and starboard sides of the windshield include dips at top portions thereof, lowering a height thereof to less than the predetermined height of the front of the windshield.

23. The watercraft of claim 22, wherein the dips facilitate lateral visibility from the seat behind the control console over both the port and starboard sides of the windshield.

24. A watercraft comprising:

a hull;

a console disposed within the hull;

a console cover disposed over the console, the console cover having an open and a closed position; and a hinge connecting the console cover to the console, permitting the console cover to be manipulated between the open and closed positions, the hinge comprising a slide rail mounted to the console, a support member pivotally attached to a forward end of the slide rail, and a slide member affixed to the console cover, the slide member pivotally attached at a first end to the support member and slidably engaging the slide rail at a second end, wherein the hinge has first and second positions corresponding to the open and closed positions of the console cover, respectively.

25. The watercraft of claim 24, wherein, when in the first position, the support member extends upwardly from the slide rail and the slide member extends at an angle from the support member to the slide rail to support the console cover in the open position.

26. The watercraft of claim 24, wherein, when in the second position, the support member and the slide member lie in substantially the same plane as the slide rail, permitting the console cover to be in the closed position.

27. The watercraft of claim 24, wherein the slide rail, the slide member, and the support member comprise a corrosion-resistant material.

28. The watercraft of claim 27, wherein the corrosion-resistant material comprises aluminum.

29. A watercraft comprising:

a hull having a transom;

a deck disposed on the hull defining at least one passenger area forward of the transom;

a table constructed and arranged to be positioned within the passenger area, the table being storable forward of the transom;

an engine mounted in the hull forward of the transom;

at least one storage compartment positioned laterally adjacent to the engine;

at least one removable wall portion disposed between the engine and the storage compartment, wherein removal of the wall portion facilitates access to at least a portion of the engine adjacent to the storage compartment; and an engine cover, the engine cover being selectively movable between closed and open positions, wherein the engine cover covers the engine when in the closed position and allows access to the engine when in the open position.

30. The watercraft of claim 29, wherein the table is positioned on the engine cover, when stored.

31. The watercraft of claim 29, wherein the engine cover mates with the removable wall portion when in the closed position.

32. The watercraft of claim 31, wherein the table is positioned on the engine cover, when stored.

33. The watercraft of claim 29, further comprising:

a second engine cover, the engine cover being selectively movable between closed and open positions, wherein the second engine cover encloses the storage compartment when in the closed position and allows access to the storage compartment when in the open position.

34. The watercraft of claim 29, wherein:

the at least one storage compartment comprises first and second storage compartments positioned laterally on each side of the engine, and the at least one removable wall portion comprises first and second removable wall portions disposed between the engine and the first and second storage compartments, respectively.

35. The watercraft of claim 34, wherein the engine cover mates with the first and second removable portions when in the closed position.

36. The watercraft of claim 35, wherein the table is positioned on the engine cover, when stored.

37. A watercraft comprising:

a hull;

a deck disposed on the hull, the deck having a floor;

at least one seat disposed on the floor; and a foot rest portion positioned forwardly adjacent to the at least one seat, the foot rest area including a central foot rest incline and at least one laterally adjacent foot rest incline, the laterally adjacent foot rest incline being disposed a predetermined distance from the central foot rest incline.

38. The watercraft of claim 37, wherein the foot rest portion is integrally molded as part of the deck.

39. The watercraft of claim 37, wherein the foot rest portion is molded as a separate component and is attached to the deck.

40. The watercraft of claim 37, wherein the central foot rest incline is disposed at an angle to the floor of between about 30 to 40 degrees.

41. The watercraft of claim 40, wherein the angle is between about 32 to 38 degrees.

42. The watercraft of claim 41, wherein the angle is between about 35 to 37 degrees.

43. The watercraft of claim 42, wherein the angle is about 36.5 degrees.

44. The watercraft of claim 37, wherein the at least one lateral foot rest incline is disposed at an angle to the floor of between 40 to 50 degrees.

45. The watercraft of claim 44, wherein the angle is between about 42 to 48 degrees.

46. The watercraft of claim 45, wherein the angle is between about 45 to 47 degrees.

47. The watercraft of claim 46, wherein the angle is about 46.2 degrees.

48. The watercraft of claim 37, wherein the at least one lateral foot rest incline comprises left and right lateral foot rest inclines disposed on either side of the central foot rest incline.

49. The watercraft of claim of claim 48, wherein the predetermined distance from the left lateral foot rest incline to the central foot rest incline is greater than that from the right lateral foot rest incline to the central foot rest incline.

50. The watercraft of claim of claim 48, wherein the predetermined distance from the left lateral foot rest incline to the central foot rest incline is less than that from the right lateral foot rest incline to the central foot rest incline.

51. The watercraft of claim of claim 48, wherein the predetermined distance from the left lateral foot rest incline to the central foot rest incline is equal to that from the right lateral foot rest incline to the central foot rest incline.

52. A watercraft comprising:

a powered hull defining port and starboard sides and a bow;

a deck disposed on the hull;

a first seat disposed on the deck, wherein the first seat is disposed adjacent to one of either the port and starboard sides, wherein the first seat is sized to accommodate two passengers in a side-by-side configuration, and wherein the first seat is pivotable from a first position to a second position;

a table retainer on the deck adjacent to the first seat, wherein the table retainer accommodates a removable table therein, and wherein, when in the first position, the first seat faces the bow and, when in the second position, the first seat faces the table retainer.

53. The watercraft of claim 52, wherein the table retainer comprises a bracket.

54. The watercraft of claim 53, wherein the bracket is removable.

55. The watercraft of claim 52, wherein:

the first seat is disposed adjacent to the port side.

56. The watercraft of claim 52, further comprising:

a second seat, disposed adjacent to the first seat on the other of the port and starboard sides, wherein the second seat is pivotable from a first position to a second position, and wherein, when in the first position, the second seat faces the bow and, when in the second position, the second seat faces the table retainer.

57. The watercraft of claim 52, wherein the table comprises:

a leg; and a table top removably connectible to the leg, wherein, when in the second position, the first seat faces the table top.

58. The watercraft of claim 56, wherein the table comprises:

a leg; and a table top removably connectible to the leg, wherein, when in the second positions, the first and second seats face the table top.

59. The watercraft of claim 52, further comprising:

an engine disposed within the hull for powering the hull; and a cover disposed over the engine, wherein the table is stowable beneath the cover when not accommodated by the table retainer.

60. The watercraft of claim 56, further comprising:

an engine disposed within the hull for powering the hull; and a cover disposed over the engine, wherein the table is stowable beneath the cover when not accommodated by the table retainer.

* * * * *